US006170424B1

(12) United States Patent
Boerseth

(10) Patent No.: US 6,170,424 B1
(45) Date of Patent: Jan. 9, 2001

(54) PRODUCTION/PLATFORM MOORING CONFIGURATION

(75) Inventor: Knut Boerseth, Tårnåsen (NO)

(73) Assignee: Petroleum Geo-Services (US), Inc., Houston, TX (US)

( * ) Notice: Under 35 U.S.C. 154(b), the term of this patent shall be extended for 0 days.

(21) Appl. No.: 09/216,309

(22) Filed: Dec. 18, 1998

Related U.S. Application Data

(63) Continuation-in-part of application No. 08/602,884, filed on Feb. 16, 1996, now abandoned.

(51) Int. Cl.[7] ..... B63B 21/24
(52) U.S. Cl. ..... 114/293; 441/3
(58) Field of Search ..... 114/230, 293; 441/3–5

(56) References Cited

U.S. PATENT DOCUMENTS

| | | | | |
|---|---|---|---|---|
| 2,777,669 | * | 1/1957 | Willis et al. | 114/263 |
| 3,082,608 | * | 3/1963 | Daniell | 114/265 |
| 3,138,135 | | 6/1964 | Langer . | |
| 3,934,531 | | 1/1976 | Allen . | |
| 4,372,240 | | 2/1983 | Michael . | |
| 4,509,448 | | 4/1985 | Pease et al. . | |
| 4,892,495 | | 1/1990 | Svensen . | |
| 5,044,297 | | 9/1991 | De Bann et al. . | |
| 5,054,415 | | 10/1991 | Marshall . | |
| 5,159,891 | | 11/1992 | Lohr et al. . | |
| 5,421,676 | | 6/1995 | Wybro et al. . | |

FOREIGN PATENT DOCUMENTS

4429 * 12/1995 (NO) .
88/06999 * 9/1988 (WO) .

* cited by examiner

*Primary Examiner*—Jesus D. Sotelo
(74) *Attorney, Agent, or Firm*—Arnold & Associates

(57) ABSTRACT

A mooring system provides a bridle having a star-like shape that is useful for mooring a single vessel or for mooring two or more vessels relative to one another. In general, the mooring system provides a mooring bridle formed of a plurality of anchor connections spaced about a central mooring position. Each anchor connection includes an anchor having a passageway therethrough and an anchor line threaded through the passageway. An anchor buoy is connected to each end of the anchor line; and a bridle line connects the anchor buoys. Adjacent anchor connections share a common anchor buoy and are, thus, interconnected. The length of the bridle lines are less than the distance between the anchors so that the diameter of the circle formed by the bridle lines is less than that formed by the anchors. Vessel lines attached to the anchor buoys extend to the central mooring position for attachment of a tender vessel thereto. An additional vessel, such as a TLP, may be attached to the mooring bridle at a position offset from the central mooring position even while the tender vessel is attached thereto. The system includes connecting lines attached to non-adjacent anchor buoys and attachable to the additional vessel and includes mooring lines attachable to the additional vessel holding the vessel to the mooring bridle. The mooring lines each include an anchor (of the adjacent anchor connection), an anchor line, an anchor buoy, and a vessel line. An alternative system includes interconnecting two mooring bridles to provide for close, effective mooring of two vessels relative to one another.

99 Claims, 10 Drawing Sheets

PRODUCTION/PLATFORM MOORING CONFIGURATION

This application is a continuation-in-part of application Ser. No. 08/602,884, filed Feb. 16, 1996, abandoned.

BACKGROUND OF THE INVENTION

1. Field of the Invention

This invention relates to systems and methods for mooring deep water, mineral production, tension leg platform (TLP) and tender vessels.

2. Related Art

Recently, relatively smaller platforms have been developed for deep sea operations where marginal production does not merit the use of a full scale tension leg platform (TLP). These marginal platforms use tension leg mooring, like conventional tension-leg platforms, but comprise smaller floatation structures. Tension-leg mooring typically comprises rigid, single-piece tendons for anchoring the structure to the sea floor, like that disclosed in *Monopod TLP Improves Deepwater Economics,* PETROLEUM ENGINEER INTERNATIONAL (January 1993), incorporated herein by reference.

It is desirable to use the TLP as a production platform, however, the weight and cost of the TLP platform increase significantly with increasing water depth and payload. Monohull vessels provide greater capacities, but they can hardly support the great weight of the risers which transport minerals from wells on the sea floor when disconnect from the operating site is required. Therefore, it is desirable to use a small riser wellhead TLP platform to suspend the risers and support the wellheads and a disconnectable tender vessel to receive, process, and export the produced minerals. The well streams are chocked and manifolded on the TLP riser platform.

Close mooring of the TLP riser platform and the production tender vessel allows for light weight flexible hoses to be used to transport the minerals. However, as the two vessels are brought into close proximity so that minerals can be transported between the TLP and the tender vessel, environmental loads induce excessive displacements on the two vessels and large loads on the transfer system.

Most mooring systems are heavy for larger water depths and rough environments so that they require larger production and tender vessels. In marginal deep sea production, larger vessels are not economical. Previously, mooring systems have been provided for single vessels. For example, U.S. Pat. No. 5,045,415, issued to Marshall on Oct. 8, 1991, incorporated herein by reference, discloses a mooring bridle. The reference suggests that different vessels may be moored within the same mooring bridle at any one time, but does not suggest connecting multiple ships to the same mooring bridle at the same time. In order to moor vessels relative to each other so that minerals may be transferred by light weight, flexible systems, the prior systems require a significant number of mooring lines increasing the overall weight of the system. Therefore, there is a need for a mooring system of two vessels which stabilizes the two vessels relative to each other without excessive loading of the vessels by the mooring system.

Another problem associated with the prior mooring systems is associated with the installation of the mooring bridle. In general, the mooring bridle includes anchors attached to the sea floor, anchor lines having one end attached to the anchor and the opposite end attached to a floating anchor buoy, and bridle lines extending between the anchor buoys. The anchors are spaced about a central mooring location so that attachment of the vessel to the mooring bridle with vessel lines holds the vessel at or near the central mooring position. However, when installed, the anchors are typically positioned at substantial depths. Attachment of the anchor line to the anchor is generally made using a remotely operated vehicle (ROV). The ROV pulls one end of the anchor line down to the installed anchor and aligns rings attached to the anchor with rings attached to the end of the anchor line. Once aligned, a dowel is inserted through the aligned rings to attach the anchor line to the anchor. In practice, the process of attaching the anchor lines to the anchors is very difficult, time consuming, and costly.

This problem is exacerbated because the anchor lines must be replaced periodically. Therefore, the difficult process of attaching the anchor lines to the anchors must be repeated, often more than once, during the lift of the mooring bridle. Accordingly, a more convenient method for attaching the anchor lines to the anchors is desired.

SUMMARY OF THE INVENTION

An object of the present invention is to address the weight and stability problems by a mooring bridle system which incorporates the TLP directly into the bridle so that the tender vessel alone may be positioned in the center of the bridle. Other objects of the present invention include providing a bridle to which multiple vessels may be attached and providing a bridle that is easier to install and maintain than prior bridles.

According to one aspect of the present invention, there is provided a system comprising: a mooring bridle, wherein the mooring bridle is installed below the wave zone of the sea and wherein the bridle is attached to a first vessel; and vessel lines which attach a second vessel to the mooring bridle.

According to another aspect of the present invention, there is provided a system comprising: an anchor which is attached to the sea floor; an anchor line comprising an upper end and a lower end wherein the lower end is connected to the anchor; an anchor line buoy which is attached to the upper end of the anchor line; and a vessel line comprising an upper end and a lower end wherein the lower end attaches to the buoy and the upper end attaches to the vessel.

According to a further aspect of the invention, there is provided a system comprising: a first mooring line; and a second mooring line, wherein the first and second mooring lines each comprise: an anchor which is attached to the sea floor; an anchor line comprising an upper end and a lower end wherein the lower end is connected to the anchor; an anchor line buoy attached to the upper end of the anchor line; and a vessel line comprising an upper end and a lower end wherein the lower end is attached to the buoy and the upper end is attached to the vessel, wherein the first and second mooring lines are placed on opposite sides of the vessel so that the net horizontal force on the vessel is zero.

According to a still further aspect of the present invention, there is provided a system comprising: a first mooring bridle; first vessel lines which attach the first vessel to the first mooring bridle; a second mooring bridle; and second vessel lines which attach the second vessel to the second mooring bridle, wherein the first and second mooring bridle are connected.

According to another aspect of the present invention, there is provided a system for mooring a vessel at sea that provides a bridle line member, an anchor line member connected to the bridle line member at a plurality of anchor line attachment locations, and the plurality of anchor line attachment locations are spaced from one another. Typically, the system also includes at least one anchor with the anchor line member attached to the at least one anchor and an anchor line member associated with each of the anchors. Preferably, the anchor line member has a first anchor line end, a middle, and a second anchor line end. The first anchor line end of the anchor line member is attached to the bridle line member at a first anchor line attachment location and the second anchor line end is attached to the bridle line member at a second anchor line attachment location with the first and second anchor line attachment locations spaced from one another. The middle of the anchor line member is attached to the at least one anchor and at least one vessel line, connected to the bridle line member, is adapted to attachment of the vessel to the bridle line member.

In one embodiment, the anchor line member comprises a single anchor line. In another embodiment, the anchor line member comprises a plurality of separate anchor lines. With one anchor line, a bight portion of the anchor line connects to the anchor and the anchor line is preferably slidably connected to the anchor. To facilitate sliding connection of the anchor line member, in one embodiment, the anchor defines a passageway therethrough and the anchor line extends through the passageway. Alternatively, in yet another embodiment, the anchor line is fixedly attached to the anchor.

In still another embodiment, at least a portion of the middle of the anchor line comprises a chain, and it is this chain portion that is connected to the anchor. Alternatively, the anchor line comprises spiral strand wire between the bridle line member and the chain or some other material.

In one alternative embodiment, the anchor line member comprises at least two anchor lines. A first of the two lines comprises the first anchor line end and a first anchor attachment end. Similarly, a second of the two lines comprises the second anchor line end and a second anchor attachment end. The first and second anchor attachment ends are attached to the anchor.

In some embodiments, the anchor comprises an anchor body adapted for attachment to the sea floor and an anchor line connector. The anchor line connector, preferably, comprises a passage member (e.g., a ring or some other passageway defined through the body). The passageway defines two openings in the anchor and the two openings are spaced from one another. Preferably, the anchor line connector has at least one fairlead.

In some embodiments, there is also provided at least one anchor buoy attached to the bridle line member. In still other embodiments, a plurality of anchor buoys are provided, attached to the bridle line member, the anchor buoys being spaced from one another.

In some embodiments of the arrangement and design of the anchor line members, the bridle line member, the anchor buoys and their related components vary. For example, in some embodiments, the first and second anchor line attachment locations are spaced from the anchor buoys, intermediate adjacent anchor buoys, each proximal an anchor buoy, or at one of the plurality of anchor buoys. With the attachment locations at one of the anchor buoys, the first anchor line attachment location is at one of the plurality of anchor buoys, and the second anchor line attachment location is at another of the plurality of anchor buoys. These anchor buoys are, alternatively, adjacent or non-adjacent. In one embodiment, the first anchor line end is attached to one of the plurality of anchor buoys, and the second anchor line end is attached to another of the plurality of anchor buoys. The first and second anchor line ends may be attached to adjacent or non-adjacent ones of the plurality of anchor buoys.

In some embodiments, the bridle line member comprises a single bridle line. In alternative embodiments, the bridle line member comprises a plurality of bridle lines. In one embodiment comprising a plurality of bridle lines, the bridle lines comprises opposing ends and a set of the plurality of bridle lines are connected to one another end-to-end. In more specific embodiments, the first and second anchor line attachment locations are attached intermediate the ends of a bridle lines of the bridle line member, proximal one of the ends of a bridle line of the bridle line member, or at one of the ends of a bridle line of the bridle line member.

Again, in various embodiments, the at least one vessel line is connected to the bridle line member intermediate the ends of a bridle line of the bridle line member, proximal one of the ends of a bridle line of the bridle line member, at one of the ends of a bridle line of the bridle line member, intermediate the first and second anchor line attachment locations, proximal one of the first and second anchor line attachment locations, or at one of the first and second anchor line attachment locations.

An alternatively embodiment provides a bridle line member comprising a plurality of bridle lines wherein each of the bridle lines has opposing ends and an anchor buoy is attached to adjacent ends of adjacent bridle lines of the bridle line member so that the bridle line member comprises a plurality of bridle lines interconnected end-to-end by a plurality of anchor buoys. In alternative embodiments having a plurality of anchor buoys attached to the bridle line member, the first and second anchor line attachment locations are attached intermediate adjacent anchor buoys, proximal adjacent anchor buoys, or to adjacent anchor buoys. Likewise, the at least one vessel line is attached to the bridle line member intermediate adjacent anchor buoys, proximal an anchor buoy, or to an anchor buoy.

Preferably, the system provides a plurality of anchor line members attached to the bridle line member that are spaced about a central mooring position. The plurality of anchor line members is arranged about the central mooring position in a triangular pattern, in some embodiments, and a star pattern in others. When a star patter is formed the star pattern comprises a multi-point star, such as a five point star pattern, a six point star pattern, or a multi-point star pattern with greater than six points. The plurality of vessel lines are attached to the bridle line member and spaced about the central mooring position.

The bridle line member, the at least one anchor, and the anchor line members comprise a bridle. As discussed, the bridle is, preferably, design for attachment of more than one vessel to the bridle. Thus, the system preferably provides at least one second vessel attachment line connected to the bridle line member that is adapted for attachment of a second vessel to the bridle line member so that a second vessel may be attached to the bridle. Typically, the system includes a plurality of second vessel lines connected to the bridle line member. One embodiment includes a second vessel mooring position defined by a first set of multiple second vessel lines attached to the bridle line member and a second set of multiple second vessel lines connected to second vessel anchor lines with the second vessel mooring position offset from the central mooring position. The first set of multiple second vessel lines comprise two connecting lines attached to the bridle line member. Preferably, the bridle incorporate a plurality of anchor buoys. The connecting lines are attached to adjacent anchor buoys, attached proximal adjacent anchor buoys, attached intermediate adjacent anchor buoys, attached to non-adjacent anchor buoys, attached proximal non-adjacent buoys, or attached intermediate non-adjacent anchor buoys. Likewise, the second vessel anchor lines are attached to adjacent anchors of the bridle or attached to non-adjacent anchors of the bridle. In one preferred embodiment, the system includes at least one second vessel anchor with the second vessel anchor lines attached to the at least one second vessel anchor.

An alternative embodiment further provides a second vessel bridle that comprises a bridle line member, at least one anchor, an anchor line member attaching the bridle line member to the at least one anchor, the anchor line member connected to the bridle line member at a plurality of anchor line attachment locations, and the plurality of anchor line attachment locations spaced from one another. The second vessel bridle is connected to the bridle. Various embodiments include one in which the bridle and second vessel bridle are connected to at least one common anchor and one in which the bridle line members of the bridle and the second vessel bridle are interconnected.

In another embodiment, the bridle further comprises a plurality of spaced anchor buoys connected to the bridle line member, and the second vessel bridle further comprises a plurality of spaced anchor buoys connected to the bridle line member. The bridle and the second vessel bridle share at least one common anchor buoy.

An alternative embodiment includes a plurality of anchors with the anchor line member attaching the bridle line member to at least two of the plurality of anchors.

According to another aspect of the present invention, there is provided a system for mooring a vessel at sea that provides at least one anchor connection. The anchor connection includes an anchor defining a passageway therethrough, an anchor line extending through the passageway of the anchor. The anchor line has opposing ends with the bight of the anchor extending through the passageway. Further included is a first anchor buoy attached to one end of the anchor line and a second anchor buoy attached to the other end of the anchor line. Preferably, the system includes a plurality of interconnected anchor connections. The end of the anchor line of one of the plurality of anchor connections is attached to the end of the anchor line of an adjacent one of the plurality of anchor connections and the adjacent anchor connections share an anchor buoy. The plurality of anchor connections are spaced about a central mooring position to define a mooring bridle has a star-like shape. The number of buoys, the number of anchor lines, the number of anchors, and the number of bridle lines are equal. At least one bridle line is attached to at least two buoys. Preferably, the at least one anchor connection provides a bridle line has opposing ends with one end of the bridle line attached to the first anchor buoy and the other end of the bridle line attached to the second anchor buoy. At least one vessel line has one end attached to the anchor connection and an opposite end adapted for selective attachment to the vessel facilitates attachment of the vessel and the mooring bridle.

A further aspect of the invention provides a method for making a mooring bridle for mooring a vessel at sea that comprises the steps of attaching at least one anchor to the sea floor, connecting an anchor line member to the at least one anchor, and attaching a bridle line member to the anchor line member at a plurality of anchor line attachment locations, the anchor line attachment locations being spaced from one another. Preferably, the method also includes the steps of providing an anchor line member for each of the at least one anchors, attaching a first end of the anchor line member to the bridle line member at a first anchor line attachment location, attaching a second end of the anchor line member to the bridle line member at a second anchor line attachment location, spaced from the first anchor line attachment location, and attaching a middle of the anchor line member to the anchor. The method may also comprise the steps of slidably connecting the anchor line member to the anchor with the anchor line member comprised of a single anchor line and providing an anchor defining a passageway therethrough and extending the anchor line through the passageway. Alternatively, the method may include the step of fixedly attaching the anchor line member to the anchor.

In one embodiment, the one step is to provide an anchor line member that comprises two anchor lines, a first of the two lines comprises the first anchor line end and a first anchor attachment end, a second of the two lines comprises the second anchor line end and a second anchor attachment end, and the first and second anchor attachment ends attached to the anchor. Another alternative step is to provide a fairlead at the connection of the anchor line member to the anchor.

Alternative steps that are included in various alternative embodiments in the method in include attaching at least one anchor buoy to the bridle line member, attaching the at least one anchor buoy to the bridle line member intermediate the first and second anchor line attachment locations, attaching the at least one anchor buoy to the bridle line member proximal one of the first and second anchor line attachment locations, and/or attaching the at least one anchor buoy to the bridle line member at one of the first and second anchor line attachment locations. The method may include the steps of attaching a plurality of anchor line buoys to the bridle line member, attaching the anchor line member first anchor line end to a first anchor buoy, and attaching the anchor line member second anchor line end to a second anchor buoy. Another optional step is the step of attaching the anchor line member first and second anchor line ends to adjacent anchor line buoys or to non-adjacent anchor line buoys.

Preferably, the method includes attaching at least one vessel line to the bridle line member with the at least one vessel line adapted for attachment of the vessel thereto. In some embodiments, this includes attaching the at least one vessel line to the bridle line member intermediate the first and second anchor line attachment locations, attaching the at least one vessel line to the bridle line member proximal one of the first and second anchor line attachment locations, or attaching the at least one vessel line to the bridle line member at one of the first and second anchor line attachment locations.

Another aspect of the method provides the steps of attaching a plurality of anchors to the sea floor, attaching an anchor line member to each of the anchors, and attaching the anchor line members to a bridle line member with the plurality of anchors and the anchor line members spaced about a central mooring position. To form various bridles having various shapes, embodiments of the method include the steps of providing three anchors and three anchor line members to form a triangular pattern about the central mooring position, providing five anchors and five anchor line members to form a five point star pattern about the central mooring position, providing six anchors and six anchor line members to form a six point star pattern about the central mooring position, or arranging the anchors and anchor line members to form a multi-point star pattern about the central mooring position. Attaching a plurality of vessel lines to the bridle line member, the plurality of vessel lines spaced about a central mooring position facilitates attachment of the vessel to the bridle.

Similarly, the steps of attaching at least one second vessel line to the bridle line member; and the at least one second vessel line adapted for attachment of a second vessel thereto, facilitates attachment of a second vessel to the bridle. One embodiment for the method involves attaching a first set of multiple second vessel lines to the bridle line member, attaching a plurality of second vessel anchor lines to anchors attached to the sea floor, and attaching each one of a second set of multiple second vessel lines to one of the plurality of second vessel lines. The at least one anchor, the anchor line member, and the bridle line member comprises a bridle.

The method includes, in various embodiments, constructing a second vessel bridle, the constructing step comprising the steps of: attaching at least one anchor to the sea floor, connecting an anchor line member to the at least one anchor, and attaching a bridle line member to the anchor line member at a plurality of anchor line attachment locations, the anchor line attachment locations spaced from one another and then connecting the second vessel bridle to the bridle. Preferably, the method of making this embodiment further comprises using some of the similar components for the bridle and the second vessel bridle for both the bridle and the second vessel bridle and/or attaching a second vessel line to the second vessel bridle, the second vessel line adapted for attachment of a second vessel thereto.

According to yet another aspect of the present invention, there is provided a method for maintaining a mooring bridle, the mooring bridle comprising at least one anchor defining a passageway therethrough and at least one anchor line extending through the passage member of the at least one anchor. The method comprises the steps of attaching an end of a replacement anchor line to an end of the at least one anchor line, pulling the opposite end of the at least one anchor line so that the replacement anchor line is pulled through the passage member as the at least one anchor line is removed, and once the placement anchor line is threaded through the passage member, disconnecting the replacement anchor line from the at least one anchor line. The replacement anchor line comprises a chain or wire at the bight portion. Further, the replacement anchor line may comprise a simple anchor line or a plurality of anchor lines.

The replacement method further comprises, in some embodiments, connecting a first replacement anchor line end of the replacement anchor line to a bridle line member of the bridle and connecting a second replacement anchor line end of the replacement anchor line to the bridle line member at a position spaced from the attachment of the first replacement anchor line end to the bridle line member. Alternatively, the replacement method comprises connecting a first replacement anchor line end of the replacement anchor line to a first anchor buoy of the bridle and connecting a second replacement anchor line end of the replacement anchor line to a second anchor buoy of the bridle, the first and second anchor buoys being spaced from one another. In another alternative, the replacement method comprises connecting a first replacement anchor line end of the replacement anchor line to a bridle line member of the bridle intermediate a first pair of anchor buoys of the bridle and connecting a second replacement anchor line end of the replacement anchor line to the bridle line member intermediate a second pair of anchor buoys of the bridle, the attachments of the first and second replacement anchor line ends to the bridle line member being spaced from one another.

BRIEF DESCRIPTION OF THE DRAWINGS

The present invention is better understood by reading the following descriptin of nonlimitative embodiments with reference to the attached drawings, wherein like parts in each of the several figures are identified by the same reference character, which are briefly described as follows.

It is to be noted, however, that the appended drawings illustrate only typical embodiments of the invention and are therefore not to be considered a limitation of the scope of the invention which includes other equally effective embodiments.

DETAILED DESCRIPTION OF THE INVENTION

Figure 1:
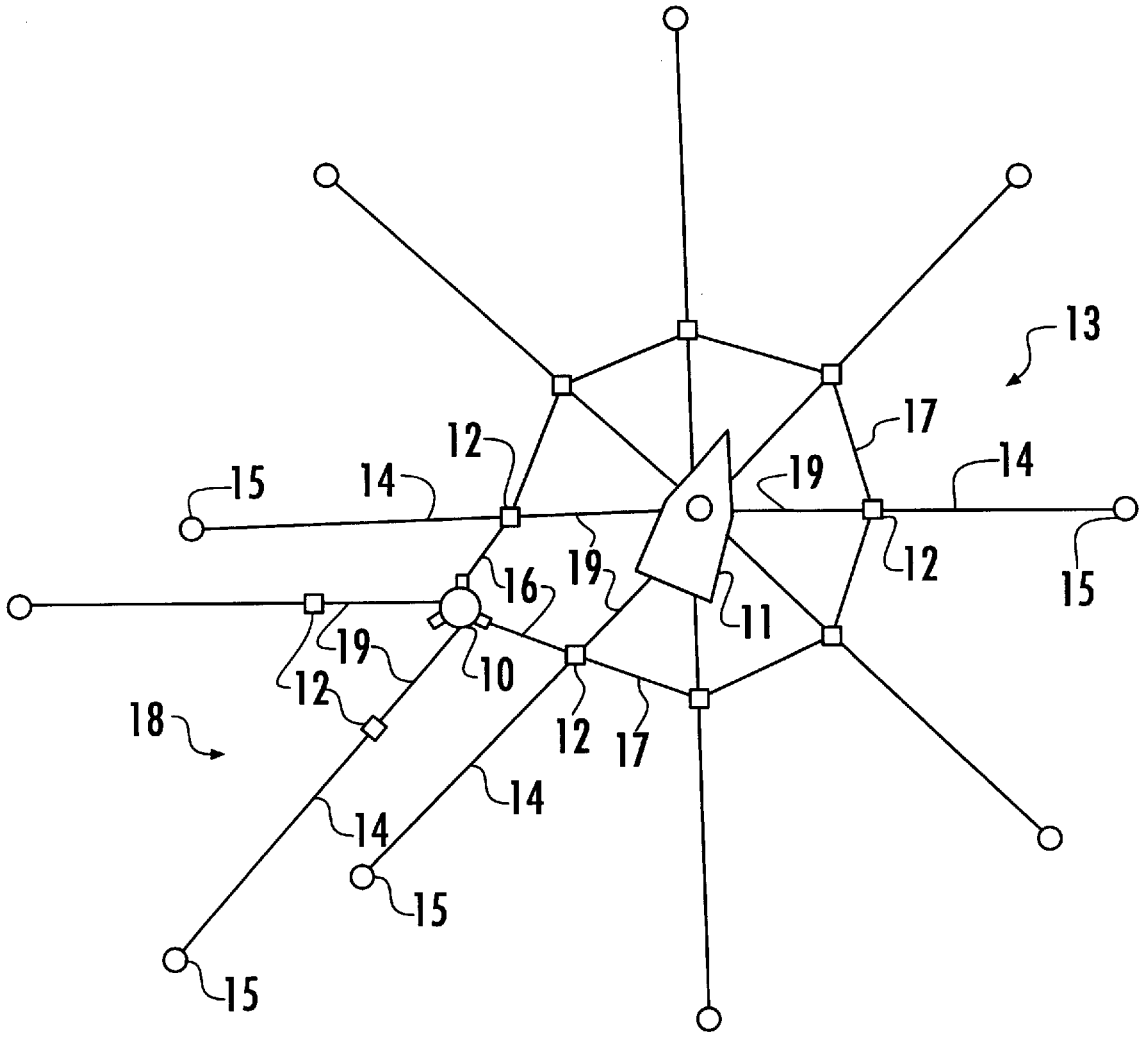
FIG. 1 is top view of an embodiment of the invention.

Referring to FIG. 1, a top view of an embodiment of the invention is shown. TLP 10 is moored to tender vessel 11 by mooring bridle 13. The mooring bridle 13 comprises anchor line buoys 12, anchor lines 14, bridle lines 17 and anchors 15. In this particular embodiment, eight of each elements are used to construct the mooring bridle, but other alternative embodiments comprise a mooring bridle constructed from any number of elements. The anchor line buoys 12 support the weight of the anchor lines 14 so that the top of the mooring bridle 13 is located below the sea wave zone. The tender vessel 11 is positioned in the middle of the mooring bridle 13 at the central mooring position and held there by vessel lines 19. One embodiment incorporates a turret to connect the vessel lines 19 to the vessel. Also, the turret is preferably buoyed so that the vessel lines 19 will remain at the surface when the tender vessel is disconnected from the turret.

The TLP is attached to the bridle 13 via chains 16. The chains 16 extend from the TLP 10 to two adjacent anchor line buoys 12. No bridle line 17 is required between these two adjacent anchor line buoys 12. Opposite to the mooring bridle 13, the TLP 10 is anchored to the sea floor by mooring lines 18. Mooring lines 18 comprise an anchor 15, an anchor line 14, an anchor buoy 12 and a vessel line 19. No bridle lines 17 are required to connect the anchor line buoys 12 of the mooring lines 18.

Figure 2A:
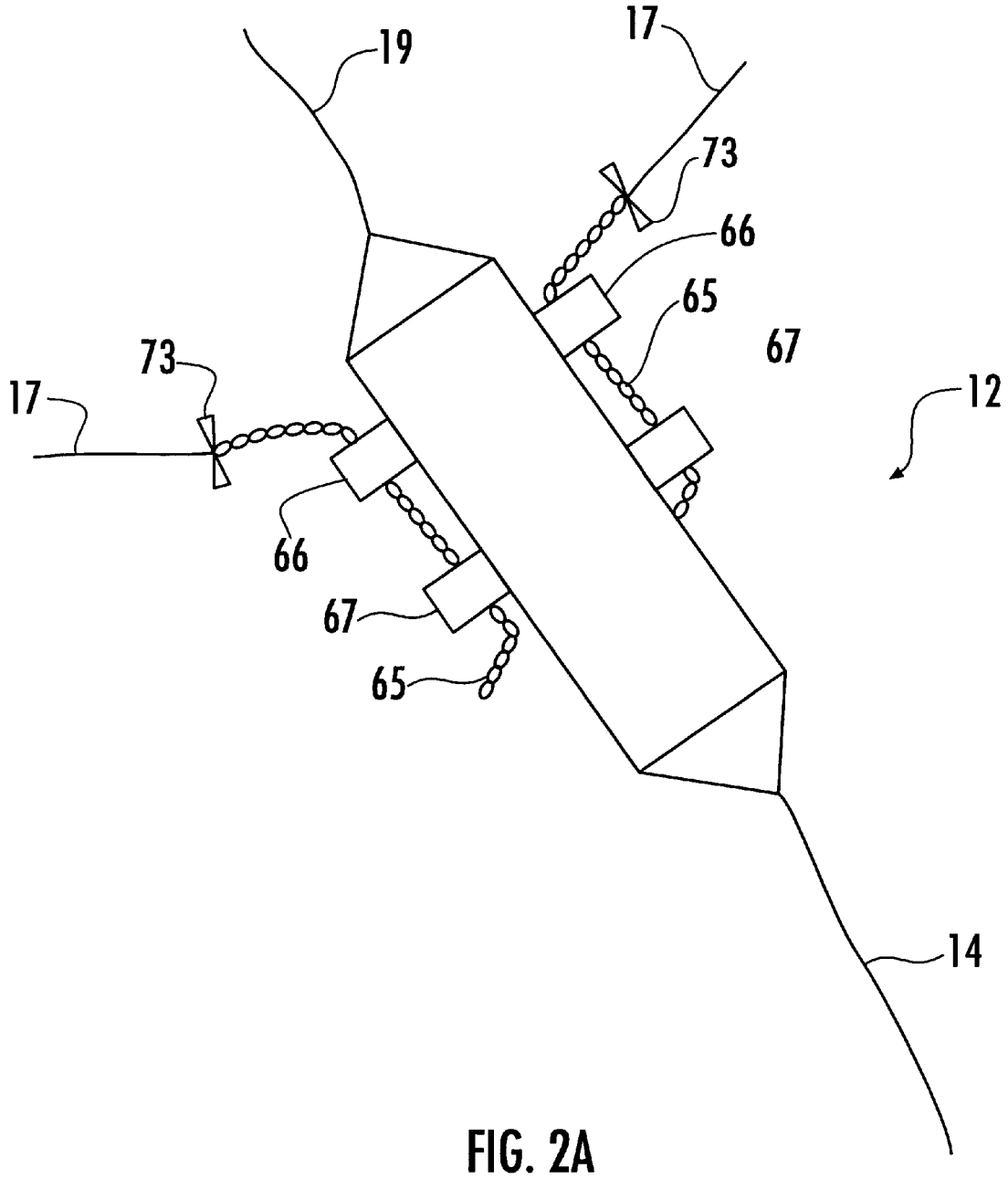
FIG. 2A is a plan view of an embodiment of a buoy for a mooring bridle.

Referring to FIG. 2*a,* an embodiment of the anchor line buoy 12 is shown. The vessel line 19 extends from the top of the buoy 12 for attachment to the vessel, while the anchor line 114 extends from the bottom of the buoy 12 for attachment to the anchor. The anchor line buoy 12 comprises a single sealed chamber filled with gas so that the buoy has positive buoyancy when placed in the sea. Alternatively, the buoy comprises a series of chambers, each filled with a substance lighter than sea water. Further, the buoy 12 is filled with a plastic, foam material, or any other material known, so that the buoy will still provide positive buoyancy even if the integrity of the buoy is breached to allow sea water to enter the buoy 12.

Figure 2B:
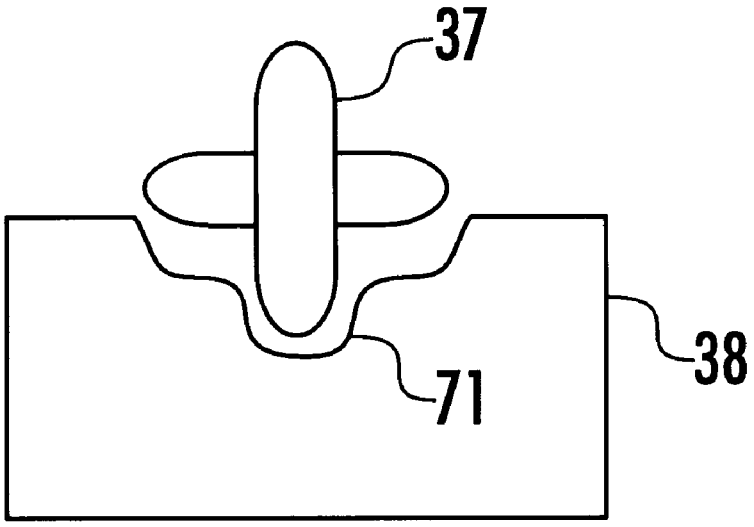
FIG. 2B is a side view of an embodiment of a deflector for a buoy of a mooring bridle.
Figure 2C:
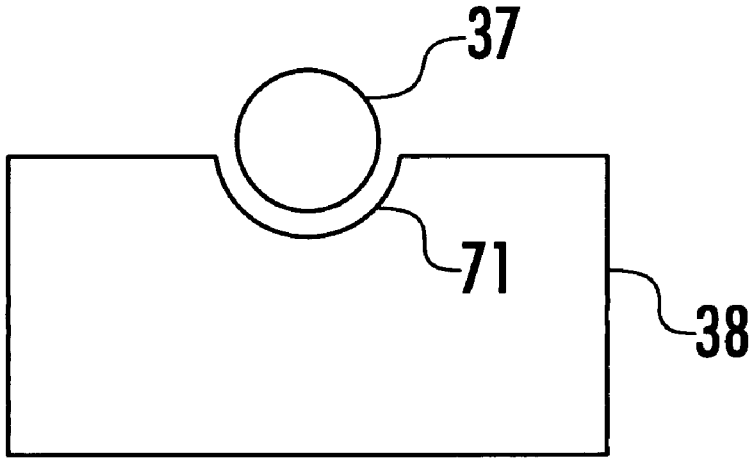
FIG. 2C is a side view of an embodiment of a deflector for a buoy of a mooring bridle.

The bridle lines 17 are attached to the buoy 12 by chains 65. In some embodiments, the bridle lines 17 are attached to the chain 65 with a spinner 73 between. The spinner 73 allows the bridle lines 17 to rotate relative to the chain 65. The chains 65 are first deflected down the sides of the buoy 12 by deflectors. These deflectors comprise pulleys, sliding material, or any other device known. FIG. 2*b,* shows a side view of sliding deflector embodiment. The chain 37 slides within a groove 71 in the deflector 38 which conforms to the shape of the chain. Alternatively, as shown in FIG. 2*c,* a cable 37 is deflected by the deflector 38, in which case, the groove 71 conforms to the shape of the cable 37. Monoloy material, produced by Smith-Berger of Vancouver, Wash., is a suitable sliding material.

The chains 65 are fastened to the buoy 12 by stoppers 67 and the excess length of chain 65 is allowed to dangle from the stoppers 67. The mooring system is adjusted by pulling the chain 65 through the deflector 66 to impose tension in the bridle lines 17. When a desired tension is obtained, the chain 65 is locked into place by a stopper 67 which is located on the buoy 12. A stopper 67 comprises two protrusions which straddle a link of the chain 65 so as to catch the next subsequent link in the chain 65. However, alternative embodiments comprise automatic stopping systems, known in the art. This stopper 67 comprises a series of stoppers which engage the chain 65 at various positions. Multiple stoppers are used to provide redundancy should one of the stoppers fail. It should be understood that the stoppers are located anywhere inside or outside the buoy 12, however, placement on the sides of the buoy 12 makes them easily accessible.

Figure 3:
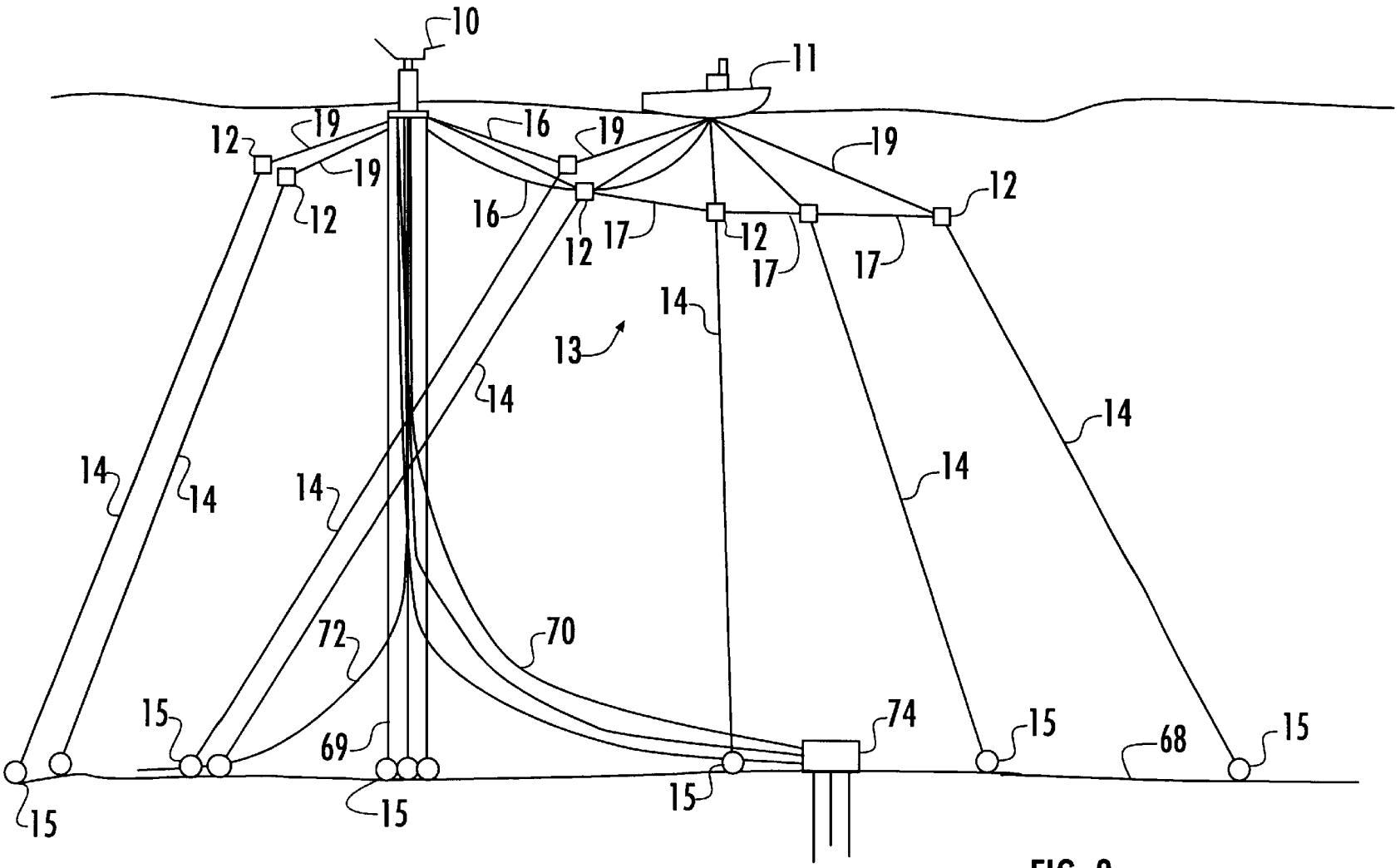
FIG. 3 is a plan view of an embodiment of the invention.

Referring to FIG. 3, a side view of an embodiment of the invention is shown. Anchors 15 are attached to the sea floor 68. Buoys 12 support anchor lines 14 and are connected in some cases by bridle lines 17. The TLP 10 is connected to two adjacent buoys 12 of the mooring bridle 13 by chains 16. The TLP 10 is secured by flexible tendons 69 which are also anchored to the sea floor 68 by anchors 15. Risers 70, for the transportation of minerals, extend from wells 74 to the TLP 10. Export riser 72 extends down from the TLP 10.

The bridle is constructed by positioning each anchor 15, with an anchor line 14 and buoy 12 attached, in its proper location around the mooring site. The anchor lines 14 are long enough to allow the anchor 15 to be suction attached to the sea floor 68 while the buoy floats on the sea surface directly above the anchor 15. Once all of the anchors 15 are in position, the buoys 12 of the bridle 13 are attached to one another with bridle lines 17. The diameter of the circle formed by the bridle 13 is smaller than the diameter of the circle formed by the anchors on the sea floor. Therefore, as the bridle lines 17 are attached to the buoys 12, the buoys become submerged below the sea surface and the anchor lines 14 become angled toward the mooring site. In one embodiment the depth of the bridle 13, once constructed, is about 30 meters. At this depth, divers are able to assemble the bridle lines 17 to the buoys 12 without difficulty. Further, the radius of the bridle 13 is about 70 meters, so that vessel lines 19 which moor the vessel 11 to the bridle are not unnecessarily lengthy. Shorter vessel lines 19 serve to reduce the mooring load on the vessel 11. The optimum angle of inclination of the anchor lines 14 and the optimum radius of the bridle 13 depend upon the size of the ship to be moored.

Figure 4:
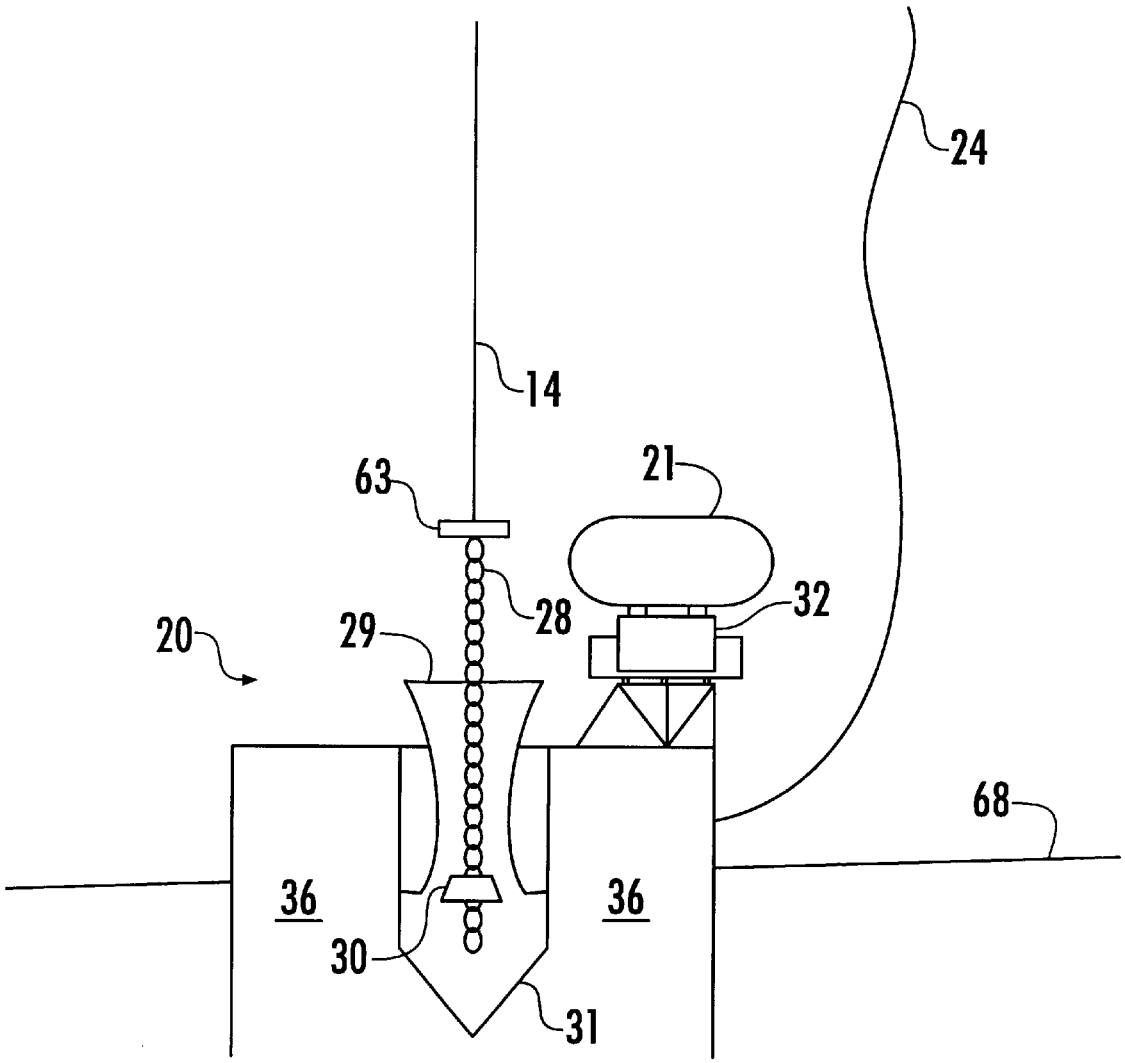
FIG. 4 is a plan view of an embodiment of a suction anchor.

Referring to FIG. 4, one embodiment of the suction anchor is shown. The anchor line 14 is attached to one end of a chain 28. A spinner 63 is used to make the connection so that the anchor line 14 is rotatable relative to the chain 28. The other end of the chain 28 is inserted into a funnel 29 located near the top of the anchor 20. Inside the funnel 29, the chain 28 is engaged by a chain stopper 30 which locks it into place. Excess links of the chain 28 are stored in a chain locker 31 below the funnel 29.

In one embodiment, for a TLP weighing about 6000 tons, the chain 28 comprises 4 inch, oil-rig-quality chain. The tendon comprises spiral strand wire having a 110 mm diameter. Further, the suction anchor 20 is made of single steel cylinders with a wall thickness of 20 mm. The total weight of the anchor ranges from about 25 tons (3.5 m diameter and 7.5 m long) to about 40 tons (5 m diameter and 11 m long). Optimum anchor size is dependent upon the size of the vessels to be moored and the depth of the sea at the mooring site, as will be understood by those of skill in the art after review of the present specification. See J-L. Colliat, P. Boisard, K. Andersen and K. Schroder, *Caisson Foundations as Alternative Anchors for Permanent Mooring of a Process Barge Offshore Congo,* OFFSHORE TECHNOLOGY CONFERENCE PROCEEDING, Vol. 2, pp. 919–929 (May 1995); E. C. Clukey, M. J. Morrison, J. Garnier and J. F. Corte, *The Response of Suction Caissons in Normally Consolidated Clays to Cyclic TLP Loading Conditions,* OFFSHORE TECHNOLOGY CONFERENCE PROCEEDING, Vol. 2, pp. 909–918 (May 1995), both incorporated herein by reference.

Figure 5A:
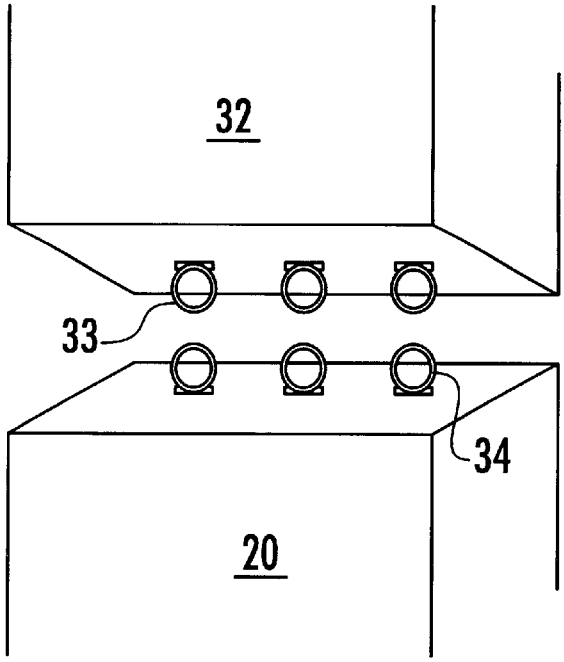
FIG. 5A is a plan view of the ROB-POD and anchor.
Figure 5B:
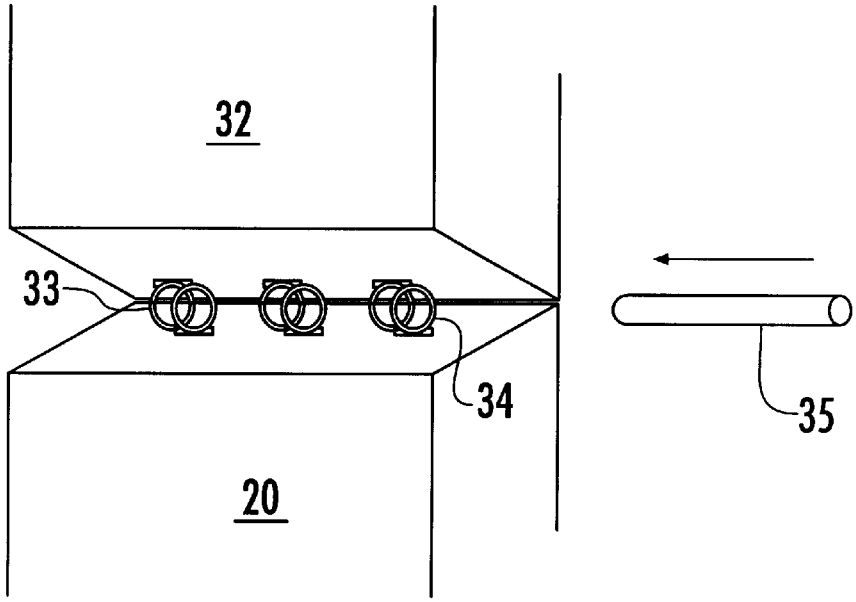
FIG. 5B is a plan view of the ROV-POD, anchor and attachment dowel.

The ROV 21 is attached to a ROV pod 32. The ROV pod 32 in turn engages the anchor 20. As shown in FIG. 5*a,* the ROV pod 32 comprises a series of rings 33. The anchor 20 also has a series of rings 34. The devices are connected by bringing the ROV pod 32 in close proximity with the anchor 20 so that rings 33 are placed adjacent to rings 34. As shown in FIG. 5*b,* with the rings juxtaposed, a dowel 35 is inserted into the rings 33 and 34 to connect the ROV pod 32 to the anchor 20.

Referring again to FIG. 4, the anchor 20 also comprises a series of chambers 36. Each of these chambers are closed on all sides with the exception of the bottom side which is adjacent to the sea floor 68. The anchor is attached to the sea floor 68 by pumping air into the chambers 36 with air supplied by umbilicals 24. Sea water is pushed out of the chambers by the air through one-way valves extending between the chambers and the exterior of the anchor. Once the chambers are filled with air, the air is immediately evacuated to create low pressure inside the chambers. This creates a suction which causes the anchor to become embedded further into the sea floor 68 and to adhere to the sea floor 68. The air is evacuated by pumps or by allowing the air in the chambers to be exposed to atmospheric pressure at the sea surface via a hose. Multiple chambers 36 provide redundancy to prevent the entire anchor from becoming detached should one of the chambers fail. When the anchor is to be released from the sea floor, air is pumped back into the chambers to increase the pressure.

Figure 6:
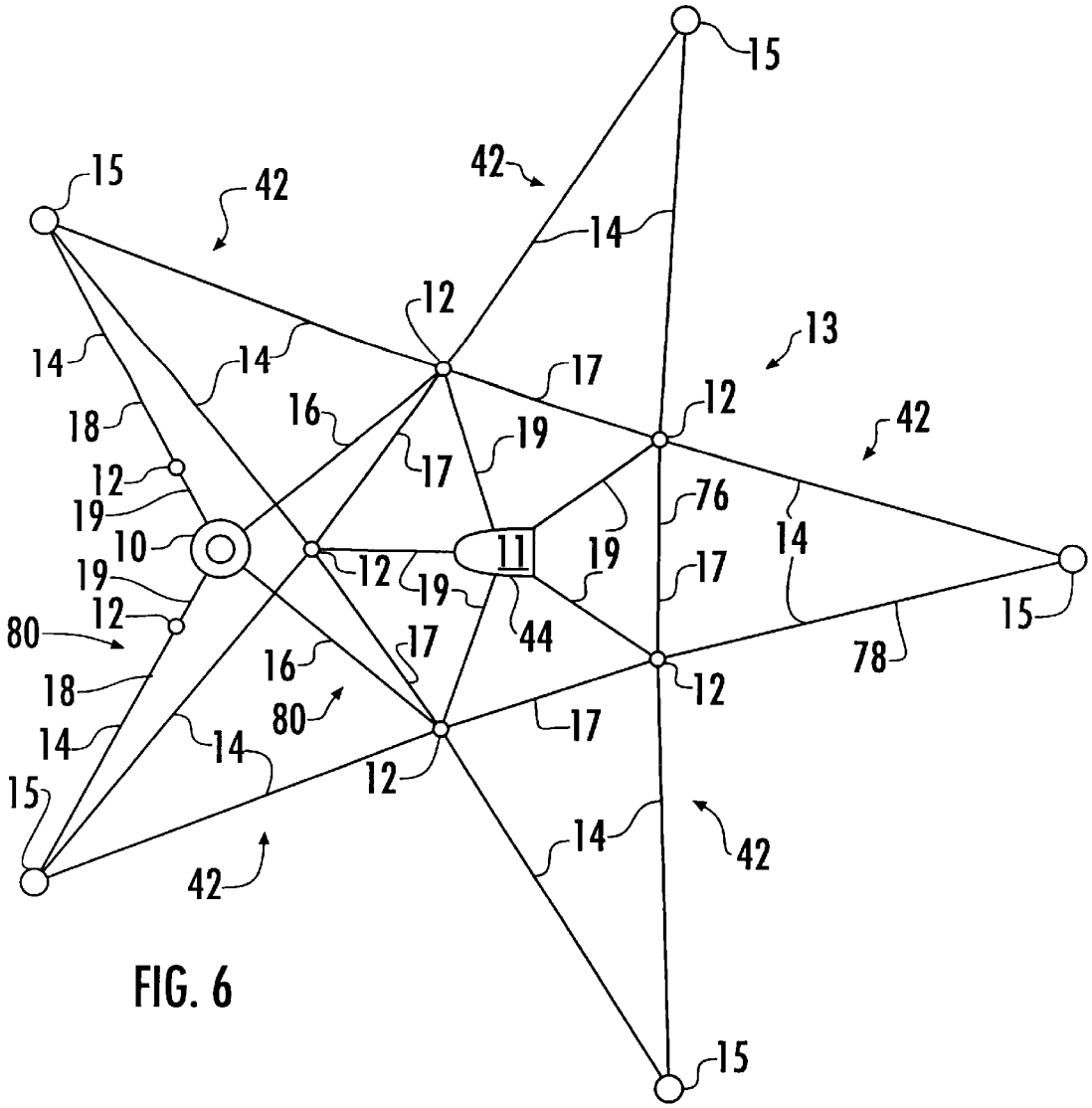
FIG. 6 is a top view of an embodiment of the invention.

FIG. 6 is a top schematic view of an alternative embodiment of the mooring system. TLP 10 is moored to tender vessel 11 by mooring bridle 13. In general, the mooring bridle 13 comprises a bridle line member 76 which, in one embodiment is a single bridle line 17 and, in other embodiments, is a plurality of bridle lines 17. The mooring bridle 13 also comprises at least one anchor 15, and an anchor line member 78 connecting the anchors 15 to the bridle line member 76. The anchor line member 78 is connected to the bridle line member 76 in at least two anchor line attachment locations that are spaced from one another. The anchor line member 78 attaches the bridle line member 76 to at least one anchor 15. Preferably, as shown in the figure, the bridle 13 includes an anchor line member 78 associated with and attached to each of the anchors 15. Within this general overview of the mooring bridle 13 lies a wide variety of possible designs. FIG. 6 shows one of these possible alternative designs.

As shown in FIG. 6, the mooring bridle 13 comprises a plurality of anchor connections 42 attached to one another and spaced about a central mooring position 44. Each of the anchor connections 42 has a triangular shape and comprises anchor buoys 12, an anchor line 14, a bridle line 17, and an anchor 15.

Figure 7:
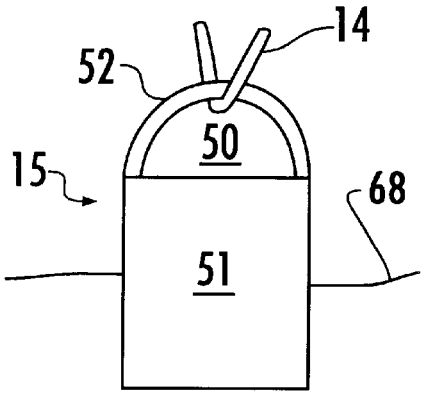
FIG. 7 is a plan view of an anchor.

The anchor 15 is attached to the sea floor 68 as previously described and as shown in FIG. 7. The anchor 15 has an anchor body 51 attached to the sea floor 68 and an anchor line connector adapted for attachment of the anchor line member 78 to the anchor 15. Preferably, the anchor line connector is a passage member 52 (which is preferably a ring portion 52; although the body 51 itself defines the passageway 50 therethrough in alternative embodiments) fixedly attached to the anchor body 51. The passage member 52 defines a passageway 50 through the anchor 15 that is sized and adapted to allow a ROV 21 to pass therethrough. Thus, the anchor 15 is mounted with the passageway 50 above the sea floor 68. Preferably, the passageway 50 is oriented vertically to facilitate maneuvering of the ROV 21 horizontally therethrough.

In one preferred embodiment, the anchor line member 78, which has a first and a second anchor line end, and a middle including a bight portion, attaches to the anchor 15 by passing the anchor line member 78 through the passageway 50 so that the ends of the anchor line member 78 are on either side of the anchor 15 and the bight extends through the passageway 50. In such an embodiment having an anchor line member 78 that passes through the passageway 50, the anchor line member 78 generally comprises a single anchor line 14 that is slidably connected to the anchor 15 at the bight portion of the anchor line 14. in some embodiments, the middle of the anchor line member 78 comprises a chain or some other material such as spiral strand wire. However, the portion of the anchor line member 78 that connects to the anchor 15 preferably comprises a chain.

Although an alternative is to have one or more anchor lines 14 fixedly attached to the anchor 15 rather than slidably passing a single anchor line 14 through a passageway 50 in the anchor 15, the preferred mooring bridle 13 uses the one anchor line configuration to facilitate maintenance of the mooring bridle 13 which is more fully discussed below. However, in such an embodiment wherein the anchor line member 78 is fixedly attached to the anchor 15, the preferred embodiment is to use two anchor lines 14. A first anchor line 14 of the two comprises the first anchor line end and a first anchor attachment end that is attached to the anchor 15. Likewise, a second anchor line 14 of the two comprises the second anchor line end and a second anchor attachment end that is attached to the anchor 15. In this way the two anchor lines 14, attached to the anchor 15, form two sides of the triangular anchor connection 42.

The first and second anchor line ends of the anchor line member 78 are attached to the bridle line member 76 at a first and second anchor line attachment location respectively. The anchor line attachment locations are spaced from one another.

In another alternative embodiment, the anchor line member 78 attaches a plurality of anchors 15 to the bridle line member 76. In this embodiment, the middle of the anchor line member 78 connects to, for example, two adjacent anchors 15 with the portion of the anchor line member 78 intermediate these adjacent anchors 15 connected to the bridle line member 76. The ends of the anchor line member 78 is also connect to the bridle line member 76.

In the embodiment shown in FIG. 6, an anchor buoy 12 is attached to each end of the anchor line 14 (at each of the anchor line attachment locations) and to the bridle line member 76 to support the weight of the anchor line 14 and to support the top of the mooring bridle 13 above the sea floor 68 and below the sea wave zone. In alternative embodiments, the anchor buoys 12 to which the anchor lines 14 are attached are adjacent of non-adjacent to one another although the embodiment of FIG. 6 shows them adjacent to one another. Thus, an anchor buoy 12 is attached to each anchor line end 14. Preferably, the portions of the anchor line 14 on each side of the anchor 15 are apportioned so that the anchor buoys 12 float at substantially the same level below the wave zone. Typically, such apportionment provides equal lengths of anchor line 14 on each side of the anchor 15. Adjacent anchor connections 42 share an anchor buoy 12 in this embodiment. Therefore, each anchor buoy 12 is attached to two anchor lines 14 and all of the buoys 12 of the mooring bridle 13 float at substantially the same level. Because the anchors 15 are spaced about the central mooring position 44, the anchor lines 14 hold the buoys 12 in spaced relation to one another holding the anchor buoys 12 intermediate two adjacent anchors 15. The anchor buoys 12 must have sufficient buoyancy to hold the weight loads placed upon them by the anchor lines 14 and other components. Other embodiments omitting the anchor buoys 12 or showing the anchor buoys 12 connected to the bridle 13 differently are discussed below in connection with other figures.

The bridle line member 76 connects the ends of the anchor line member(s) 78 to one another and defines the top of the mooring bridle 13. The bridle line member 76 holds the tops of the anchor line member(s) 8 proximal one another and provides a location for attachment of the bridle to the vessel 11. The bridle line member comprises a single bridle line 17 in one embodiment and a plurality of bridle lines 17 in an alternative embodiment. However, the preferred embodiment of the bridle line member 76 comprises a plurality of bridle lines 17 to facilitate assembly and maintenance of the bridle 13. Typically, a bridle line 17 extends between two adjacent anchor buoys 12 or, if the bridle 13 does not include anchor buoys 12, between adjacent anchor line attachment locations. In some embodiments, the bridle lines 17 are connected to one another end-to-end to form a continuous bridle line member 76. Anchor buoys 12, in some embodiments, are used to facilitate the attachment of the bridle lines 17.

In the embodiment shown in FIG. 6, the bridle line 17 of the anchor connection 42 is attached to and connects the anchor buoys 12 of the anchor connection 42 (as mentioned, an alternative is to use a single bridle line 17 to connect the buoys 12 of more than one anchor connection 42). The bridle line length between two adjacent anchor line attachment locations is less than the distance between the anchors 15. Therefore, the bridle lines 17 hold the anchor buoys 12 such that the distance between the anchor buoys 12 (or anchor line attachment locations) is less than the distance between the anchors 15. Further, because the anchor connections 42 are interconnected, as are the anchor buoys 12, by the bridle lines 17, the anchor buoys 12 define a circle having a diameter that is less than the diameter of the circle formed by the anchors 15. Accordingly, the bridle lines 17 pull the anchors 15 inward toward one another and hold them in position proximal the central mooring position 44 which is located at the center of the anchor buoys 12. Consequently, the attached anchor connections 42 oriented about the central mooring position 44 define a star-like shape having the anchors 15 as the outermost points of the star. The number of points of the star depends upon the number of anchor connections 42.

In the particular embodiment shown in FIG. 6, five anchor connections 42 are used to construct the mooring bridle 13, but other embodiments comprise any number of elements. As each anchor connection 42 contains one anchor 15, one anchor line 14, and one bridle line 17, and because the adjacent anchor connections 42 share an anchor buoy 12, the number of anchors 15, anchor lines 14, anchor buoys 12, and bridle lines 17 are equal. The resulting bridle defines a five point star pattern. Note that other shapes and star patterns are possible by varying the number of anchor connections 42. Using three anchor connections 42 produces a triangular pattern; using six anchor connections 42 produces a six point star pattern; and using more than six anchor connections 42 produces a multi-point star pattern with more than six points.

To attach a tender vessel 11 to the mooring bridle 13, the system includes a vessel line 19 having one end attached to the bridle line member 76. FIG. 6 shows a vessel line 19 having one end attached to each of the anchor buoys 12, at each end of the bridle lines 17 and at each anchor line attachment location. The opposite end of the vessel line 19 is adapted to selective attachment to the tender vessel 11. Although certain embodiments of the system omit some vessel lines 19 and do not include a vessel line 19 attached to all of the anchor buoys 12, the preferred system includes an equal number of vessel lines 19 and anchor buoys 12. A turret is preferably used to connect the vessel lines 19 to the vessel 11. Also, the turret is preferably buoyed so that the vessel lines 19 will remain at the surface when the tender vessel 11 is disconnected form the turret. During use, the tender vessel 11 is positioned in the middle of the mooring bridle 13 at the central mooring position 44 and held thereby the vessel lines 19 as shown in the figure.

The bridle 13 is designed to allow a second vessel 10 to be attached to the mooring bridle 13. This is generally accomplished using at least one, but preferably a plurality of, second vessel attachment lines 80 adapted to attach the second vessel 10 to the bridle line member 76 so that the second vessel is attached to the bridle 13. The second vessel attachment lines 80 comprise connecting lines 16 that connect the second vessel 10 to the bridle line member 76 and mooring lines 18 that connect the second vessel to anchors 15. Within this broad scope of possible connections lies a wide variety of possible embodiments. However, in addition to these embodiments is another general embodiment which is further discussed below in connection with FIG. 17 that uses two interconnected bridles 13 to connect a vessel 11 and a second vessel 10.

In FIG. 6, a second vessel, such as the TLP 10, is attached to the bridle 13 via connecting lines, or chains 16. The connecting lines 16 extend from the TLP 10 to anchor buoys 12. Preferably, the anchor buoys 12 to which the connecting lines 16 attach are non-adjacent. It has been found that, in practice, attaching the connecting liens 16 to adjacent buoys 12 often produces substantial snapping of the connecting lines 16, whereas attaching the connecting liens 16 to non-adjacent anchor buoys 12 substantially reduces, or eliminates, snapping of the connecting lines 16.

Figure 15:
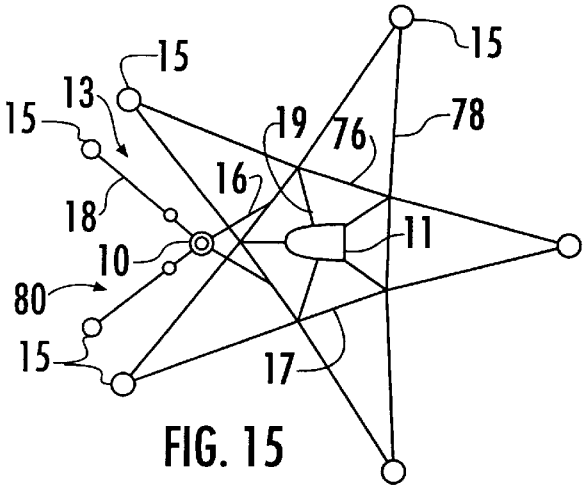
FIG. 15 is a top view of an alternative embodiment of the invention.
Figure 16:
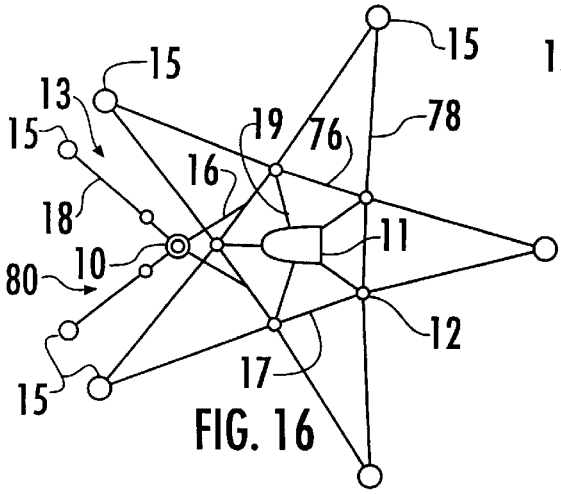
FIG. 16 is a top view of an alternative embodiment of the invention.

Opposite to the mooring bridle 13, the TLP 10 is anchored to the sea floor 68 by mooring lines 18. Mooring lines 18 comprise an anchor 15, an anchor line 14, an anchor buoy 12, and a vessel line 19. However, in some embodiments, the anchors 15 for the mooring lines 18 are the anchors 15 of the adjacent anchor connections 42 as shown in the figure although, in other embodiments, they attach to non-adjacent anchors 15 of the bridle 13 or to anchors 15 separate from the bridle 13 (FIGS. 15 and 16). No bridle lines 17 are required to connect the anchor buoys 12 of the mooring lines 18.

Figure 8:
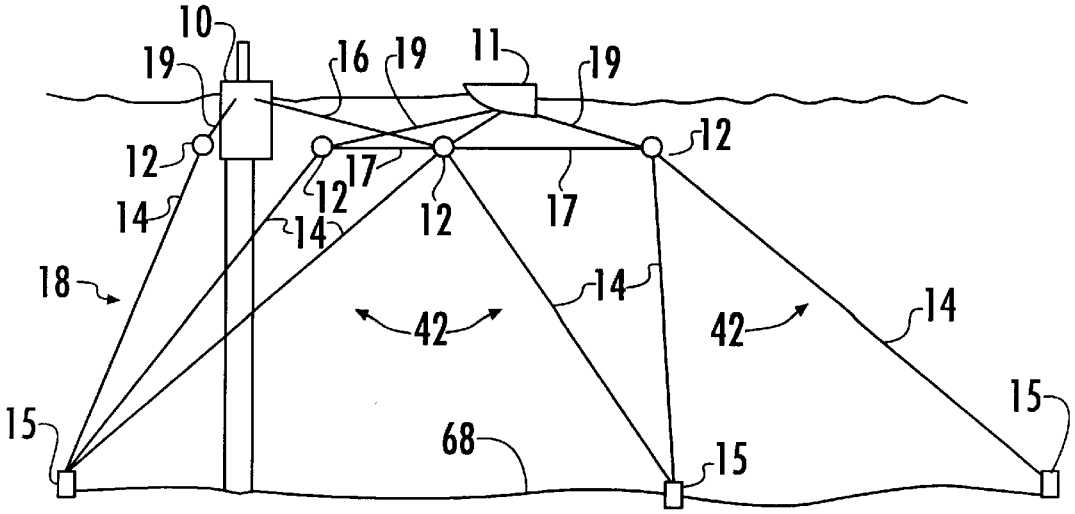
FIG. 8 is a plan view of an embodiment of the invention.

FIG. 8 is a side view of the embodiment of the invention shown in FIG. 6. Anchors 15 are attached to the sea floor 68. Anchor buoys 12 support anchor lines 14 and are connected by bridle lines 17. The anchor buoys 12 are maintained below the wave zone and are spaced about the central mooring position 44. The TLP 10 is connected to two non-adjacent buoys 12 of the mooring bridle 13 by connecting lines 16. The TLP 10 is secured by flexible tendons 69 which are also anchored to the sea floor 68 by anchors 15.

Figure 9A:
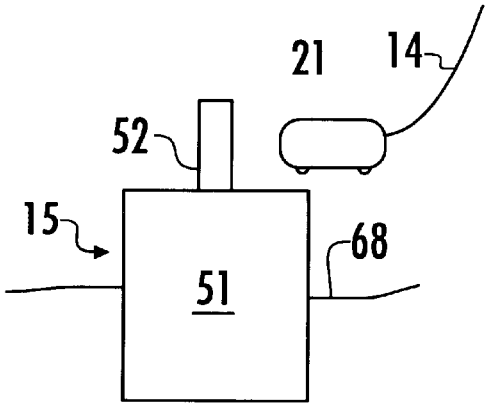
FIGS. 9A and 9B are plan view of the ROV and anchor.
Figure 9B:
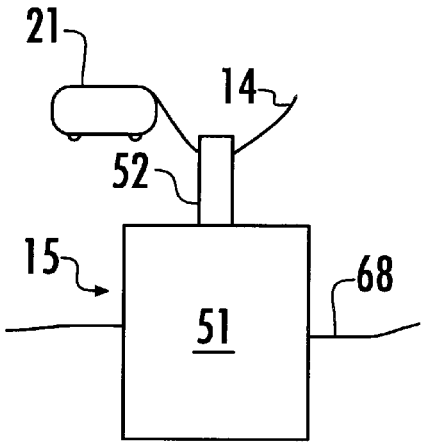

The construction of the mooring bridle 13 is similar to the construction of the embodiment shown in FIG. 1 and previously described. However, the connection of the anchor lines 14 to the anchors 15 is much simpler due to the improved design of the anchors 15 (i.e. the threaded anchor line 14) and mooring bridle 13 (i.e. the star-like shape). FIGS. 9A and 9B are side views showing the connection of the anchor line 14 to the anchor 15. To attach the anchor line 14 to the anchor 15, once the anchor 15 has been attached to the sea floor 68, one end of the anchor line 14 is attached to an ROV 21 while the other end is held at the surface. The ROV 21 is then maneuvered down to the anchor 15 as shown in FIG. 9A and then maneuvered through the passageway 50 of the anchor threading the anchor line 14 therethrough as shown in FIG. 9B. Once the anchor line 14 is threaded through the ring portion 52 of the anchor 15, the ROV 21 is returned to the surface. With both ends at the surface, the anchor buoys 12, bridle lines 17, and vessel lines 19 are attached.

Figure 10A:
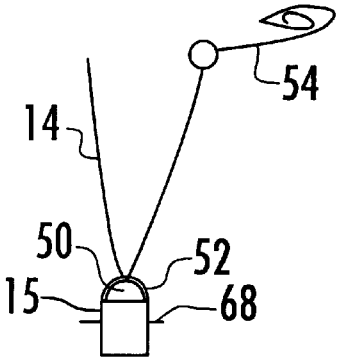
FIGS. 10A through 10C are plan views of an anchor showing the procedure for replacement of the anchor line.
Figure 10B:
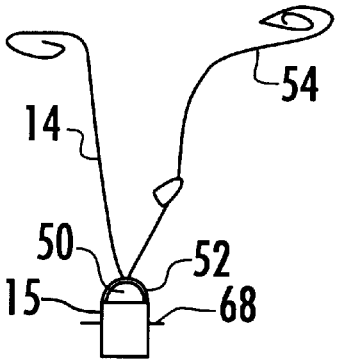
Figure 10C:
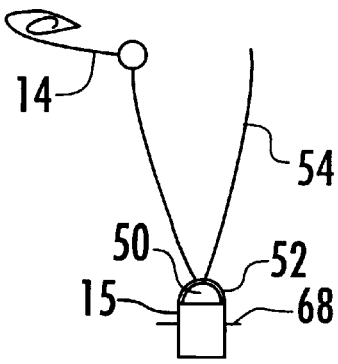

One advantage of using a single anchor line 14 threaded through a ring portion 52 of the anchor 15 and having two buoys 12 attached thereto, is that the design facilitates fast, low cost maintenance of the mooring bridle 13 by easing replacement of the anchor lines 14. Periodically, the anchor lines 14 require replacement due to normal wear-and-tear. FIGS. 10A though 10C illustrate the anchor line replacement procedure with the preferred system. The anchor buoys 12 are disconnected from the anchor line 14 and one end of a replacement anchor line 54 is attached to one end of the anchor line 14 as shown in FIG. 10A. The opposite end of the anchor line 14 is then pulled to remove the anchor line 14 from the anchor 15 and simultaneously thread the replacement anchor line 54 through the passageway 50 of the anchor 15 (the opposite end of the replacement anchor line 54 is held at the surface) as shown in FIG. 10B. Finally, with the anchor line 14 pulled completely to the surface, the anchor line 14 and replacement anchor line 54 are detached from one another and the mooring bridle 13 reassembled using the replacement anchor line 54. Prior systems requiring the use of an ROV 21 to attach the anchor line 14 to an ROV pod 32 connected to the anchor 15 are much more time consuming and difficult and much less efficient that the present threaded anchor line system.

Figure 11:
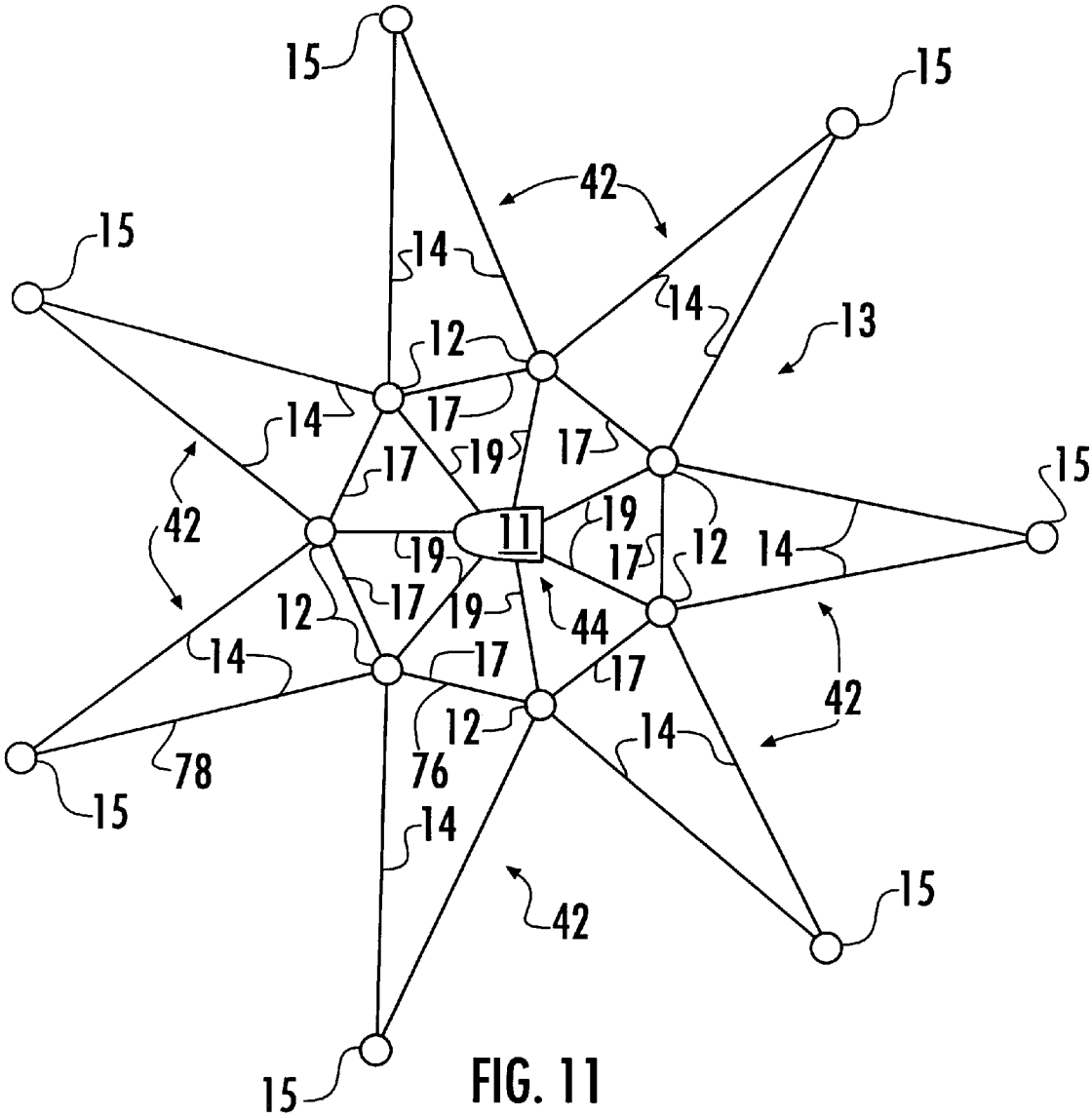
FIG. 11 is a top view of an embodiment of the invention.

FIG. 11 is a top view of an alternative embodiment wherein the mooring bridle 13, having seven anchor connections 42, is used to moor a single vessel 11 at sea. Although the present invention is directed primarily at a mooring system for mooring two vessels relative to one another, the disclosed, improved mooring bridle 13 is also effective for mooring a single vessel 11. Further, other embodiments of the mooring bridle 13 are used to moor more than two vessels by providing more than one additional mooring position, along with the associated connecting lines 15 and mooring lines 18.

Figure 12:
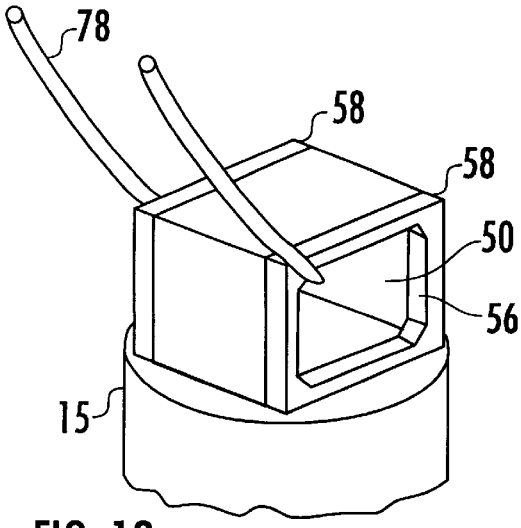
FIG. 12 is a perspective view of the anchor having fairleads attached thereto.

FIG. 12 is a perspective view of one embodiment of the anchor 15. In this embodiment, the anchor line connector comprises a passage member 52 defining a passageway 50. The passageway defines two openings 56 that are spaced from one another. Attached to the anchor 15 at each of the openings 56 is a fairlead 58 adapted to facilitate movement of the anchor line member 78 through the passageway 50. Alternative embodiments of the fairlead 58 include rollers or other typical means to facilitate the movement and provide for reduced chafing of the anchor line member 78 as it moves through the passageway 50.

As previously mentioned, the mooring bridle 13 components are assembled and attached in a variety of alternative ways to construct the bridle 13. Alternative embodiments of the bridle 13 include anchor buoys 12, while others do not include anchor buoys 12. Further, in alternative embodiments, the anchor line members 78 attach to (i.e. the anchor line attachment locations are positioned at) anchor buoys 12, intermediate anchor buoys 12, proximal anchor buoys 12, to adjacent or non-adjacent anchor buoys 12, at the ends of bridle lines 17, intermediate the ends of bridle lines 17, and/or proximal the ends of bridle lines 17, etc. Likewise, vessel lines 19 and connecting lines 16 are connected to/at, intermediate, or proximal the anchor buoys 12 and the ends of the bridle lines 17 in alternative embodiments. The anchor buoys 12 to which the vessel lines 19 attach are adjacent in some embodiments and non-adjacent in others. FIGS. 13 through 16 show some of the possible resulting combinations and are further discussed below.

Figure 13:
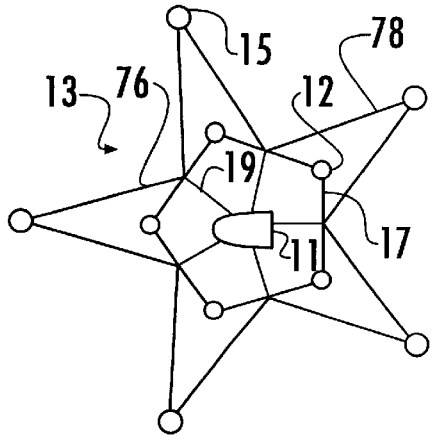
FIG. 13 is a top view of an alternative embodiment of the invention.

FIG. 13 is a top view of one embodiment of the invention. In this embodiment, the bridle 13 comprises a bridle line member 76 having a plurality of anchor buoys 12 connected thereto, a plurality of anchors 15 spaced about a central mooring position 44, and an anchor line member 78 associated with each of the anchors 15 connecting the bridle line member 76 to the anchors 15. The anchor line attachment locations are positioned between the anchor buoys 15 to the bridle line member 76. For a bridle line member 76 comprising a plurality of bridle lines 17 attached end-to-end with an anchor buoy 15 between adjacent bridle lines 17, the anchor line attachment locations are positioned intermediate to the ends of the bridle lines 17. More specifically, the first and second anchor line attachment ends of an anchor line member 78 are attached between the ends of adjacent bridle lines 17 and the associated anchor buoys 12. Likewise, the vessel lines 19 are attached between the ends of adjacent bridle lines 17 and the associated anchor buoys 12.

Figure 14:
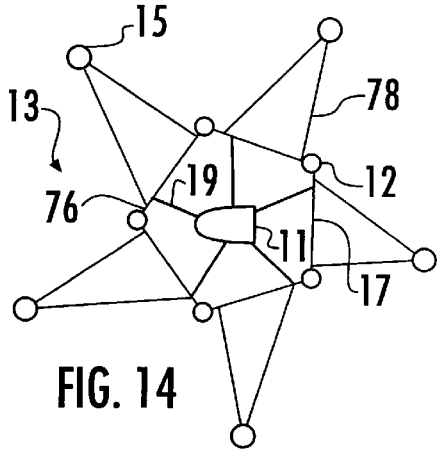
FIG. 14 is a top view of an alternative embodiment of the invention.

FIG. 14 is a top view of another alternative embodiment of the present invention. The bridle 13 comprises a bridle line member 76 having a plurality of anchor buoys 12 connected thereto, a plurality of anchors 15 spaced about a central mooring position 44, and an anchor line member 78 associated with each of the anchors 15 connected the bridle line member 76 to the anchors 15. The bridle line member 76 comprises a plurality of bridle lines 17 interconnected end-to-end by anchor buoys 12. The anchor line attachment locations are on the bridle line member 76 and the ends of the anchor lines 14 and the vessel lines 19 attach to the bridle line member 76 intermediate, but proximal, the anchor buoys 12 and the ends of the bridle lines 17. Note that the first and second attachment ends and the first and second anchor line attachment locations of each of the anchor line members 76 attach to a single bridle line 17. Also, the attachment location of the vessel lines 19 to the bridle line member 78 is offset from the anchor line attachment locations. Further, the anchor line attachment locations of adjacent anchor line members are offset from one another.

FIG. 15 is a top view of another embodiment of the mooring bridle 13 having a vessel 11 and a TLP 10 attached thereto. In this embodiment, the bridle 13 comprises a bridle line member 76, a plurality of anchors 15 spaced about a central mooring position 44, and an anchor line member 78 associated with each of the anchors 15 connecting the bridle line member 76 to the anchors 15. The embodiment omits the anchor buoys 12. The connecting lines 16 connecting the second vessel 10 to the bridle 13 attach to the mooring bridle 13 intermediate adjacent ends of the bridle lines 17 (the bridle line member 76 comprising a plurality of bridle lines 17). Further, the mooring lines 18 connected to the second vessel 10 use second vessel anchors 15 that are separate from the anchors 15 of the mooring bridle. In a similar embodiment, shown in FIG. 16 which does include anchor buoys 12, the connecting lines 16 attach to the bridle line member 78 intermediate, yet proximal, the anchor buoys 12 and the ends of the bridle lines 17. The anchor buoys 12 to which the connecting lines 16 attach are adjacent in certain embodiments and non-adjacent in others.

Figure 17:
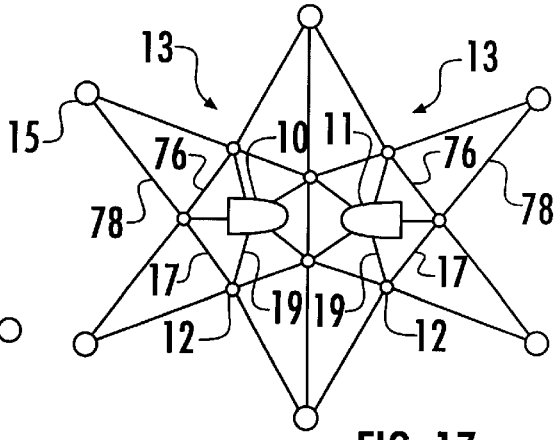
FIG. 17 is a top view of an alternative embodiment of the invention.

FIG. 17 is a top view showing an alternative embodiment wherein two-mooring bridles are interconnected. The first mooring bridle 13 comprises a plurality of anchors 15, anchor line members 78, a bridle line member 76, and vessel lines 19 attached as previously described. Similarly, a second vessel bridle 13 comprises a bridle line member 76, anchors 15, and anchor line members 78 interconnected as previously described for a bridle 13. The bridle 13 and the second vessel bridle 13 are connected to one another. The connection of the bridles 13 are accomplished in a number of ways. For example, in one embodiment, bridle lines 17 or connecting lines 16 extend between the bridles 13; in another embodiment, the bridles share common anchors 15, anchor line members 78, bridle lines 17, anchor buoys 12, or other bridle components. In the embodiment shown in FIG. 17, the bridles 13 share common anchors 15, anchor lines 14, anchor buoys 15, and bridle lines 17. Using the interconnected bridles, the vessel 11 and second vessel 10 are closely and effectively moored relative to one another.

It is to be noted that the above described embodiments illustrate only typical embodiments of the invention and are therefore not to be considered a limitation of the scope of the invention which includes other equally effective embodiments.

What is claimed is:

1. A system for mooring a vessel at sea, the system comprising:

a bridle line member;

at least one anchor;

an anchor line member having a first anchor line end, a middle, and a second anchor line end;

the first anchor line end being attached to the bridle line member at a first anchor line attachment location;

the second anchor line end being attached to the bridle line member at a second anchor line attachment location, the first and second anchor line attachment locations being spaced from one another;

the middle of the anchor line member being attached to the at least one anchor; and at least one vessel line connected to the bridle line member, the at least one vessel line adapted for attachment of the vessel to the bridle line member.

2. The system of claim 1, wherein the anchor line member comprises a single anchor line.

3. The system of claim 2, wherein a bight portion of the anchor line connects to the anchor.

4. The system of claim 2, wherein the anchor line is slidably connected to the anchor.

5. The system of claim 4, wherein at least a portion of the middle of the anchor line comprises a chain.

6. The system of claim 5, wherein the at least a portion of the middle comprising the chain comprises at least the portion connected to the anchor.

7. The system of claim 6, wherein the anchor line comprises spiral strand wire between the bridle line member and the chain.

8. The system of claim 4, wherein:

the anchor defines a passage therethrough; and the anchor line extends through the passageway.

9. The system of claim 1, wherein:

the anchor line member comprises at least two anchor lines;

a first of the two lines comprising the first anchor line and a first anchor attachment end;

a second of the two lines comprising the second anchor line end and a second anchor attachment end; and the first and second anchor attachment ends are attached to the anchor.

10. The system of claim 1, wherein the bridle line member comprises a plurality of bridle lines.

11. The system of claim 10, wherein:

each of the plurality of bridle lines comprises opposing ends; and a set of the plurality of bridle lines are connected to one another end-to-end.

12. The system of claim 11, wherein the first and second anchor line attachment locations are each intermediate the ends of a bridle line of the bridle line member.

13. The system of claim 11, wherein the first and second anchor line attachment locations are each proximal one of the ends of a bridle line of the bridle line member.

14. The system of claim 11, wherein the first and second anchor line attachment locations are each at one of the ends of a bridle line of the bridle line member.

15. The system of claim 11, wherein the at least one vessel line is connected to the bridle line member intermediate the ends of a bridle line of the bridle line member.

16. The system of claim 11, wherein the at least one vessel line is connected to the bridle line member proximal one of the ends of a bridle line of the bridle line member.

17. The system of claim 11, wherein the at least one vessel line is connected to the bridle line member at one of the ends of a bridle line of the bridle line member.

18. The system of claim 11, wherein the at least one vessel line is connected to the bridle line member intermediate the first and second anchor line attachment locations.

19. The system of claim 11, wherein the at least one vessel line is connected to the bridle line member proximal one of the first and second anchor line attachment locations.

20. The system of claim 11, wherein the at least one vessel line is connected to the bridle line member at one of the first and second anchor line attachment locations.

21. The system of claim 10, further comprising:

each of the bridle lines having opposing ends;

an anchor buoy attached to adjacent ends of adjacent bridle lines of the bridle line member; and so that the bridle line member comprises a plurality of bridle lines interconnected end-to-end by a plurality of anchor buoys.

22. The system of claim 21, wherein first and second anchor line attachment locations are each intermediate adjacent anchor buoys.

23. The system of claim 21, wherein first and second anchor line attachment locations are each proximal adjacent anchor buoys.

24. The system of claim 21, wherein first and second anchor line ends attach to adjacent anchor buoys.

25. The system of claim 21, wherein the at least one vessel line is attached to the bridle line member intermediate adjacent anchor buoys.

26. The system of claim 21, wherein the at least one vessel line is attached to the bridle line member proximal an anchor buoy.

27. The system of claim 21, wherein the at least one vessel line is attached to an anchor buoy.

28. The system of claim 1, further comprising a plurality of anchor line members attached to the bridle line member spaced about a central mooring position.

29. The system of claim 28, wherein the plurality of anchor line members are arranged about the central mooring position in a triangular pattern.

30. The system of claim 28, further comprising a plurality of vessel lines attached to the bridle line member and spaced about the central mooring position.

31. The system of claim 1, wherein the bridle line member, the at least one anchor, and the anchor line members comprise a bridle.

32. The system of claim 31, further including:

at least one second vessel attachment line connected to the bridle line member;

for attachment of a second vessel to the bridle line member;

so that a second vessel may be attached to the bridle.

33. A system for mooring a vessel at sea, the system comprising:

a bridle line member;

at least one anchor comprising an anchor body adapted for attachment to the sea floor and an anchor line connector;

an anchor line member having a first anchor line end, a middle, and a second anchor line end;

the first anchor line end being attached to the bridle line member at a first anchor line attachment location;

the second anchor line end being attached to the bridle line member at a second anchor line attachment location, the first and second anchor line attachment locations being spaced from one another;

the middle of the anchor line member being attached to the at least one anchor; and at least one vessel line connected to the bridle line member, the at least one vessel line adapted for attachment of the vessel to the bridle line member.

34. The system of claim 33, wherein the anchor line connector comprises a passage member.

35. The system of claim 34, wherein the passage member comprises a ring.

36. The system of claim 34, wherein the passage member comprises the body defining a passageway therethrough.

37. The system of claim 36, wherein:

the passageway defines two openings in the anchor; and the two openings are spaced from one another.

38. The system of claim 33, wherein the anchor line connector further comprising at least one fairlead.

39. A system for mooring a vessel at sea, the system comprising:

a bridle line member;

at least one anchor;

an anchor line member having a first anchor line end, a middle, and a second anchor line end;

the first anchor line end being attached to the bridle line member at a first anchor line attachment location;

the second anchor line end being attached to the bridle line member at a second anchor line attachment location, the first and second anchor line attachment locations being spaced from one another;

the middle of the anchor line member being attached to the at least one anchor;

at least one vessel line connected to the bridle line member, the at least one vessel line adapted for attachment of the vessel to the bridle line member; and at least one anchor buoy attached to the bridle line member.

40. The system of claim 39, further comprising a plurality of anchor buoys attached to the bridle line member, the anchor buoys being spaced from one another.

41. The system of claim 40, wherein the first and second anchor line attachment locations are spaced from the anchor buoys.

42. The system of claim 40, wherein the first and second anchor line attachment locations are intermediate adjacent anchor buoys.

43. The system of claim 40, wherein the first and second anchor line attachment locations are each proximal an anchor buoy.

44. The system of claim 40, wherein:

the first anchor line attachment location is at one of the plurality of anchor buoys; and the second anchor line attachment location is at another of the plurality of anchor buoys.

45. The system of claim 40, wherein:

the first anchor line end is attached to one of the plurality of anchor buoys; and the second anchor line end is attached to another of the plurality of anchor buoys.

46. The system of claim 45, wherein the first and second anchor line ends are attached to adjacent ones of the plurality of anchor buoys.

47. The system of claim 45, wherein the first and second anchor line ends are attached to non-adjacent ones of the plurality of anchor buoys.

48. A system for mooring a vessel at sea, the system comprising:

a bridle line member;

at least one anchor;

a plurality of anchor line members spaced and arranged about a central mooring position in a star pattern, each anchor line member having a first anchor line end, a middle, and a second anchor line end;

the first anchor line end being attached to the bridle line member at a first anchor line attachment location;

the second anchor line end being attached to the bridle line member at a second anchor line attachment location, the first and second anchor line attachment locations being spaced from one another;

the middle of the anchor line member being attached to the at least one anchor; and at least one vessel line connected to the bridle line member, the at least one vessel line adapted for attachment of the vessel to the bridle line member.

49. The system of claim 48, wherein the star pattern comprises a five point star pattern.

50. The system of claim 48, wherein the star pattern comprises a six point star pattern.

51. The system of claim 48, wherein the star pattern comprises a multi-point star pattern greater than six.

52. A system for mooring a vessel at sea, the system comprising:

a bridle line member;

at least one anchor;

at least one anchor line member having a first anchor line end, a middle, and a second anchor line end, the bridle line member, the at least one anchor, and the at least one anchor line member comprising a bridle;

the first anchor line end being attached to the bridle line member at a first anchor line attachment location;

the second anchor line end being attached to the bridle line member at a second anchor line attachment location, the first and second anchor line attachment locations being spaced from one another;

the middle of the anchor line member being attached to the at least one anchor;

at least one vessel line being connected to the bridle line member, the at least one vessel line adapted for attachment of the vessel to the bridle line member;

at least one second vessel attachment line connected to the bridle line member for attachment of a second vessel to the bridle line member so that a second vessel may be attached to the bridle; and a plurality of second vessel lines connected to the bridle line member.

53. A system for mooring a vessel at sea, the system comprising:

a bridle line member;

at least one anchor;

at least one anchor line member having a first anchor line end, a middle, and a second anchor line end, the bridle line member, the at least one anchor, and the at least one anchor line member comprising a bridle;

the first anchor line end being attached to the bridle line member at a first anchor line attachment location;

the second anchor line end being attached to the bridle line member at a second anchor line attachment location, the first and second line attachment locations being spaced from one another;

the middle of the anchor line member being attached to the at least one anchor;

at least one vessel line being connected to the bridle line member, the at least one vessel line adapted for attachment of the vessel to the bridle line member;

at least one second vessel attachment line connected to the bridle line member for attachment of a second vessel to the bridle line member so that a second vessel may be attached to the bridle; and a second vessel mooring position defined by a first set of multiple second vessel lines attached to the bridle line member and a second set of multiple second vessel lines connected to second vessel anchor lines, the second vessel mooring position offset from the central mooring position.

54. The system of claim 53, wherein the first set of multiple second vessel lines comprise two connecting lines attached to the bridle line member.

55. The system of claim 54, further comprising the bridle further comprising a plurality of anchor buoys.

56. The system of claim 55, wherein the connecting lines are attached to adjacent anchor buoys.

57. The system of claim 55, wherein the connecting lines are attached proximal adjacent anchor buoys.

58. The system of claim 55, wherein the connecting lines are attached intermediate adjacent anchor buoys.

59. The system of claim 55, wherein the connecting lines are attached to non-adjacent anchor buoys.

60. The system of claim 55, wherein the connecting lines are attached proximal non-adjacent anchor buoys.

61. The system of claim 55, wherein the connecting lines are attached intermediate non-adjacent anchor buoys.

62. The system of claim 53, wherein the second vessel anchor lines are attached to adjacent anchors of the bridle.

63. The system of claim 53, wherein the second vessel anchor lines are attached to non-adjacent anchors of the bridle.

64. The system of claim 53, further comprising:

at least one second vessel anchor; and the second vessel anchor lines attached to the at least one second vessel anchor.

65. The system of claim 53, further comprising:

a second vessel bridle comprising:

a bridle line member;

at least one anchor;

an anchor line member attaching the bridle line member to the at least one anchor;

the anchor line member connected to the bridle line member at a plurality of anchor line attachment locations; and the plurality of anchor line attachment locations spaced from one another;

the second vessel bridle connected to the bridle.

66. The system of claim 65, wherein the bridle and second vessel bridle are connected to at least one common anchor.

67. The system of claim 65, wherein the bridle line members of the bridle and the second vessel bridle are interconnected.

68. The system of claim 65, wherein:

the bridle further comprises a plurality of spaced anchor buoys connected to the bridle line member;

the second vessel bridle further comprises a plurality of spaced anchor buoys connected to the bridle line member;

and the bridle and the second vessel bridle share at least one common anchor buoy.

69. A system for mooring a vessel at sea, the system comprising:

a plurality of anchors;

a bridle line member; and an anchor line member connected to the bridle line member at a plurality of anchor line attachment locations spaced from one another, the anchor line member attaching the bridle line member to at least two of the plurality of anchors.

70. A system for mooring a vessel at sea, the system comprising:

a plurality of interconnected anchor connections, a plurality of which comprise:

an anchor;

an anchor line member having opposing ends and a middle , the middle of the anchor line member attached to the anchor;

wherein the end of the anchor line member of one of the plurality of anchor connections is attached to the end of the anchor line member of an adjacent one of the plurality of anchor connections.

71. The system of claim 70, further comprising the plurality of anchor connections spaced about a central mooring position to define a mooring bridle having a triangular shape.

72. The system of claim 70, further comprising a bridle line member attached to the anchor connections.

73. The system of claim 70, wherein the at least one anchor connection further comprises:

a bridle line having opposing ends; and one end of the bridle line attached to one end of the anchor line member and the other end of the bridle line attached to the other end of the anchor line member.

74. The system of claim 70, wherein the at least one anchor connection further comprises at least one anchor buoy.

75. The system of claim 70, further comprising at least one vessel line having one end attached to the anchor connection and an opposite end adapted for selective attachment to the vessel.

76. A system for mooring a vessel at sea, the system comprising:

a plurality of interconnected anchor connections, a plurality of which comprise:

an anchor;

an anchor line member having opposing ends and a middle, the middle of the anchor line member attached to the anchor, wherein the plurality of anchor connections is spaced about a central mooring position to define a mooring bridle having a star-line shape.

77. A method of making a mooring bridle for mooring a vessel at sea, comprising the steps of:

attaching a plurality of anchors to the sea floor;

connecting a set of anchor line members, each anchor line member having a first end, a second end, and a middle, to the plurality of anchors;

attaching the first end of at least one of the anchor line members to a bridle line member at a first anchor line attachment location;

attaching the second end of the anchor line member to the bridle line member at a second anchor line attachment location spaced from the first anchor line attachment location; and attaching the middle of the anchor line member to one of the anchors;

wherein the bridle line member is attached to the anchor line members at a plurality of anchor line attachment locations, the anchor line attachment locations being spaced from one another.

78. The method of claim 77, further comprising the step of slidably connecting the anchor line member to the anchor, the anchor line member comprising a single anchor line.

79. The method of claim 78, further comprising the steps of:

providing an anchor defining a passageway therethrough; and extending the anchor line through the passageway.

80. The method of claim 77, further comprising the step of providing a fairlead at the connection of the anchor line member to the anchor.

81. The method of claim 77, further comprising the step of attaching at least one anchor buoy to the bridle line member intermediate the first and second anchor line attachment locations.

82. The method of claim 77, further comprising the step of attaching at least one anchor buoy to the bridle line member proximal one of the first and second anchor line attachment locations.

83. The method of claim 77, further comprising the step of attaching the at least one anchor buoy to the bridle line member at one of the first and second anchor line attachment locations.

84. The method of claim 77, further comprising the steps of:

attaching a plurality of anchor line buoys to the bridle line member;

attaching the anchor line member first anchor line end to a first anchor buoy; and attaching the anchor line member second anchor line end to a second anchor buoy.

85. The method of claim 84, further comprising the step of attaching the anchor line member first and second anchor line ends to adjacent anchor line buoys.

86. The method of claim 84, further comprising the step of attaching the anchor line member first and second anchor line ends to non-adjacent anchor line buoys.

87. The method of claim 84, comprising the step of attaching at least one vessel line to the bridle line member, the at least one vessel line adapted for attachment of the vessel thereto.

88. The method of claim 87, further comprising the step of attaching the at least one vessel line to the bridle line member intermediate the first and second anchor line attachment locations.

89. The method of claim 87, further comprising the step of attaching the at least one vessel line to the bridle line member proximal one of the first and second anchor line attachment locations.

90. The method of claim 87, further comprising the step of attaching the at least one vessel line to the bridle line member at one of the first and second anchor line attachment locations.

91. A method of making a mooring bridle for mooring a vessel at sea, comprising the steps of:

attaching a plurality of anchors to the sea floor;

connecting a set of anchor line members, each anchor line member having a first end, a second end, and a middle, to the plurality of anchors;

attaching a bridle line member to the anchor line members at a plurality of anchor line attachment locations, the anchor line attachment locations being spaced from one another;

attaching a plurality of anchor line buoys to the bridle line member;

attaching the first end of at least one of the anchor line members to a first anchor buoy and to the bridle line member at a first anchor line attachment location;

attaching the second end of the anchor line member to a second anchor buoy and to the bridle line member at a second anchor line attachment location spaced from the first anchor line attachment location;

attaching the middle of the anchor line member to one of the anchors;

attaching at least one first vessel line to the bridle line member, the at least one vessel line adapted for attachment of the vessel thereto; and attaching at least one second vessel line to the bridle line member, the at least one second vessel line adapted for attachment of a second vessel thereto.

92. The method of claim 91, further comprising the steps of:

attaching a first set of multiple second vessel lines to the bridle line member;

attaching a plurality of second vessel anchor lines to anchors attached to the sea floor; and attaching each one of a second set of multiple second vessel lines to one of the plurality of second vessel lines.

93. A method of making a mooring bridle for mooring a vessel at sea, comprising the steps of:

attaching a plurality of anchors to the sea floor;

connecting a set of anchor line members, each anchor line member having a first end, a second end, and a middle, to the plurality of anchors;

attaching the first end of at least one of the anchor line members to a bridle line member at a first anchor line attachment location;

attaching the second end of the anchor line member to the bridle line member at a second anchor line attachment location spaced from the first anchor line attachment location;

attaching the middle of the anchor line member to one of the anchors;

wherein the bridle line member is attached to the anchor line members at a plurality of anchor line attachment locations, the anchor line attachment locations being spaced from one another; the plurality of anchors, the anchor line members, and the bridle line member comprising a bridle;

constructing a second vessel bridle, the constructing step comprising the steps of:

attaching at least one anchor to the sea floor;

connecting an anchor line member to the at least one anchor;

attaching a bridle line member to the anchor line member at a plurality of anchor line attachment locations, the anchor line attachment locations spaced from one another; and connecting the second vessel bridle to the bridle.

94. The method of claim 93, further comprising the step of using some of the similar components for the bridle and the second vessel bridle for both the bridle and the second vessel bridle.

95. The method of claim 93, further comprising the step of attaching a second vessel line to the second vessel bridle, the second vessel line adapted for attachment of a second vessel thereto.

96. A method for maintaining a mooring bridle, the mooring bridle comprising at lest one anchor defining a passage member therethrough and at least one anchor line extending through the passage member of the at least one anchor, the method comprising the steps of:

attaching an end of a replacement anchor line to an end of the at least one anchor line;

pulling the opposite end of the at least one anchor line so that the replacement anchor line is pulled through the passage member as the at least one anchor line is removed; and once the placement anchor line is threaded through the passage member, disconnecting the replacement anchor line from the at least one anchor line.

97. The method of claim 96, further comprising:

connecting a first replacement anchor line end of the replacement anchor line to a bridle line member of the bridle; and connecting a second replacement anchor line end of the replacement anchor line to the bridle line member at a position spaced from the attachment of the first replacement anchor line end to the bridle line member.

98. The method of claim 96, further comprising:

connecting a first replacement anchor line end of the replacement anchor line to a first anchor buoy of the bridle; and connecting a second replacement anchor line end of the replacement anchor line to a second anchor buoy of the bridle, the first and second anchor buoys spaced from one another.

99. The method of claim 96, further comprising:

connecting a first replacement anchor line end of the replacement anchor line to a bridle line member of the bridle intermediate a first pair of anchor buoys of the bridle; and connecting a second replacement anchor line end of the replacement anchor line to the bridle line member intermediate a second pair of anchor buoys of the bridle, the attachments of the first and second replacement anchor line ends to the bridle line member being spaced from one another.

* * * * *

UNITED STATES PATENT AND TRADEMARK OFFICE

CERTIFICATE OF CORRECTION

PATENT NO. : 6,170,424 B1
DATED : January 9, 2001
INVENTOR(S) : Knut Børseth

It is certified that error appears in the above-identified patent and that said Letters Patent is hereby corrected as shown below:

Title page,
Under "References Cited", following the listed Foreign Patent Documents, should read:
--OTHER DOCUMENTS 1. "Monopod TLP Improves Deepwater Economics," Petroleum Engineer, Jan. 1993.
2. Engstrand, et al, "Smaller Production System Allowed by Mooring Network," Offshore, August, 1994, pg. 74-77 --.

Column 2,
Line 18, "during the lift of the" should read -- during the life of the --.

Column 4,
Line 25, the word "alternatively" should read -- alternative --.
Line 67, "the bridle incorporate" should read -- the bridle incorporates --.

Column 5,
Line 50, the word "has" should read -- having --.

Column 6,
Line 26, "the method in include" should read -- the method include --.

Column 7,
Line 44, the word "simple" should read -- single --.

Column 8,
Line 4, the word descriptin" should read -- description --.

UNITED STATES PATENT AND TRADEMARK OFFICE

CERTIFICATE OF CORRECTION

PATENT NO. : 6,170,424 B1
DATED : January 9, 2001
INVENTOR(S) : Knut Børseth

It is certified that error appears in the above-identified patent and that said Letters Patent is hereby corrected as shown below:

Column 8,
Line 19, "of the ROB-POD" should read -- of the ROV-POD --.
Line 25, "plan view of" should read -- plan views of --.

Column 9,
Line 13, "line 114 extends" should read -- line 14 extends --.

Column 11,
Line 61, "in some embodiments" should read -- In some embodiments --.

Column 12,
Line 27, "78 is also" should read -- 78 also --.
Line 35, adjacent of non-adjacent" should read -- adjacent or non-adjacent --.
Line 59, "member(s) 8 proximal" should read -- member(s) 78 proximal --.

Column 15,
Line 27, "lines 15 and" should read -- lines 16 and --.
Line 64, "anchor buoys 15" should read -- anchor buoys 12 --.
Line 67, "anchor buoy 15" should read -- anchor buoy 12 --.

Column 16,
Line 13, the word "connected" should read -- connecting --.
Line 22, "members 76 attach" should read -- members 78 attach --.
Line 48, "wherein two-mooring" should read -- wherein two mooring --.
Line 52, the "vessel bridle 13" should read -- mooring bridle 13 --.
Line 54, "The bridle 13" should read -- The first mooring bridle 13 --.
Line 55, the "second vessel bridle 13" should read -- second mooring bridle 13 --.

UNITED STATES PATENT AND TRADEMARK OFFICE

CERTIFICATE OF CORRECTION

PATENT NO. : 6,170,424 B1
DATED : January 9, 2001
INVENTOR(S) : Knut Børseth

It is certified that error appears in the above-identified patent and that said Letters Patent is hereby corrected as shown below:

Claims,
Claim 8,
Line 2, the word "passage" should read -- passageway --.

Claim 9,
Line 4, "anchor line" should read -- anchor line end --.

Claim 38,
Line 2, the word "comprising" should read -- comprises --.

Claim 53,
Line 13, "second line" should red -- second anchor line --.

Claim 87,
Line 1, "claim 84, comprising" should read -- claim 84, further comprising --.

Signed and Sealed this

Second Day of October, 2001

*Attest:*

Nicholas P. Godici

*Attesting Officer*

NICHOLAS P. GODICI
*Acting Director of the United States Patent and Trademark Office*